US006739453B1

(12) United States Patent
Mazurek

(10) Patent No.: US 6,739,453 B1
(45) Date of Patent: May 25, 2004

(54) PRODUCT PACKAGING HAVING A NON-THERMOFORMED BLISTER-LIKE COMPARTMENT AND METHODS FOR MAKING SAME

(75) Inventor: Richard Mazurek, Huntingdon Valley, PA (US)

(73) Assignee: IMPAC Group, Inc., New York, NY (US)

( * ) Notice: Subject to any disclaimer, the term of this patent is extended or adjusted under 35 U.S.C. 154(b) by 95 days.

(21) Appl. No.: 09/671,330

(22) Filed: Sep. 25, 2000

(51) Int. Cl.[7] ..... B65D 73/00
(52) U.S. Cl. ..... 206/461; 206/806
(58) Field of Search ..... 206/461, 471, 206/806, 467–470

(56) References Cited

U.S. PATENT DOCUMENTS

| | | | | |
|---|---|---|---|---|
| 1,938,490 | A | | 2/1933 | Locke |
| 3,608,705 | A | | 9/1971 | Moshel |
| 4,858,756 | A | | 8/1989 | Herrin et al. |
| 5,069,334 | A | | 12/1991 | Herrin et al. |
| 5,117,972 | A | | 6/1992 | Herrin et al. |
| 5,154,293 | A | * | 10/1992 | Gould ..... 206/461 |
| 5,429,233 | A | | 7/1995 | Juaristi |
| 5,485,919 | A | * | 1/1996 | Samberg et al. ..... 206/461 |
| 5,564,569 | A | | 10/1996 | Kiefer |
| 5,819,939 | A | * | 10/1998 | Boyer ..... 206/461 |
| 6,053,321 | A | * | 4/2000 | Kayser ..... 206/470 |

* cited by examiner

*Primary Examiner*—Shian Luong
(74) *Attorney, Agent, or Firm*—Priest & Goldstein, PLLC

(57) ABSTRACT

A product package is described for enclosing an item in a non-thermoformed blister-like compartment. Also described are approaches for making the package. According to various aspects of the described package and manufacturing techniques, a blank is cut out of a sheet of see-through plastic material, the blank having a plurality of panels and flange sections such that the blank can be formed, without thermoforming, into a blister-like compartment having a plurality of panels defining an enclosure with a mouth at its base and a flange at the mouth's perimeter. The blank may include printing, cutouts, perforations, or other features. The blank is then folded into a blister-like compartment and loaded with the item to be packaged. A backing is positioned to enclose the loaded blister-like compartment and affixed to the flange.

20 Claims, 22 Drawing Sheets

PRODUCT PACKAGING HAVING A NON-THERMOFORMED BLISTER-LIKE COMPARTMENT AND METHODS FOR MAKING SAME

BACKGROUND OF THE INVENTION

1. Field of the Invention

The present invention relates generally to improvements in product packaging, and particularly to advantageous aspects of product packaging having a non-thermoformed blister-like compartment and methods for making same.

2. Description of the Prior Art

In the product packaging industry, there is continuing interest in creating packaging that, on the one hand, is useful and visually appealing but that, on the other hand, does not unduly add to the manufacturing costs of the product being sold. One popular type of packaging that is commonly used to package lower-end products is the blister package. In a blister package, a sheet of plastic is thermoformed (i.e., heated and stretched) into a "blister" that is shaped to receive a retail item. The blister typically includes a flange at the outer perimeter of its base that is used to adhere the blister to the front surface of a "card," which is a flat sheet of cardboard or plastic that serves as a backing for the package.

Blisters are typically manufactured automatically in bulk using a thermoforming machine that is fed by a bulk roll of plastic. After the blisters have been manufactured, they are then transferred into a loading and sealing machine, in which each blister is loaded with a retail product and then heat-sealed to a card. Blisters are commonly manufactured at a facility that is different from the manufacturing facility used to load and seal the finished package. Where this is the case, the thermoformed blisters must be transported to the loading and sealing facility and stored for future use.

Blister packaging is selected to package a particular item for a number of reasons. First, blister packaging is relatively inexpensive. A basic blister package requires only two pieces of material, the thermoformed blister and a card. In addition, a blister package can be loaded and sealed in a high-speed automatic or semi-automatic manufacturing process that minimizes labor costs. Also, because a blister is typically fabricated from a transparent plastic, the retail item inside the package is plainly visible to retailers and their customers. Further, blister packaging provides a security function. Because blister packaging is heat-sealed, a retail customer typically may not remove the retail item from the packaging without visibly damaging the packaging.

However, there are a number of disadvantages associated with blister packaging. One disadvantage is that blister packaging tends to have an unattractive appearance that can be associated in the buying public's mind with a lower-end product. Thus, blister packaging may be undesirable where a manufacturer desires a more upscale image for a particular product. A second disadvantage of blister packaging is that once a blister has been thermoformed, it becomes relatively bulky. The added bulk increases the amount of space required for transportation and storage of thermoformed blisters prior to the time that they are assembled into finished packages.

Further, once the blister has been formed, care must be taken to insure that the blisters do not "nest," i.e., stick together as they are being fed into the loading and sealing machine. One solution to the nesting problem is to thermoform de-nesting lugs into the blister, which serve to create a gap between adjacent blisters in a stack. However, the de-nesting lugs may detract from the esthetic appearance of the blister. Further, the de-nesting lugs significantly further increase the bulk of a stack of blisters, thus resulting in a further increased need for space in transporting and storing the thermoformed blisters.

Another disadvantage of thermoformed blisters is that they do not lend themselves well to decoration. Although many printing, coating and other types of techniques have been developed over the years for applying a design or text to the surface of a plastic, these techniques are limited in application to a thermoformed blister for a number of reasons. First, thermoforming machines run at their highest efficiency using roll-fed stock. As a practical matter, this eliminates high quality sheet-fed lithographic printing techniques, in which single sheets of plastic are used rather than a bulk roll. Attempts have been made to use roll-fed lithographic and flexographic printing techniques to apply designs to rolls of plastic stock prior to thermoforming, but these have proven to be generally unsatisfactory because of the inability to consistently control the amount of plastic distortion during thermoforming and because of the limited flexibility of the inks used.

Thus, the decoration of blisters has typically been limited to processes that are performed after the blister has been thermoformed, utilizing such techniques as tampo printing, silkscreen, or hot stamping technology. However, because the blister is now a three-dimensional object rather than a two-dimensional sheet, these techniques have proven to be expensive, slow, and limited in their ability to produce high quality multicolor images. Thus, these techniques are usually performed as a one up part in conjunction with thermoforming. Where attempts have been made to print directly onto a thermoformed blister, the printing is typically limited to a blister having a flat front panel, and the printing may only be applied to that panel. No practical techniques have yet been developed for printing directly onto the side panels of a thermoformed blister.

A common technique that is used to decorate a blister package is to use a printed label that is affixed to the blister, or a printed insert that is visible through the blister. The results obtained using labels and inserts are typically not particularly esthetic. Labels have a "stick-on" appearance, and inserts generally "float" behind a blister panel. In addition, labels and inserts entail additional manufacturing costs for materials and printing, and require the manufacturer to acquire and maintain inventory and application equipment over and above that needed for functionality.

A further drawback of blister packages is that they do not lend themselves particularly well to automated die cutting in those situations in which it is desired to provide openings or cutout sections in the finished blister. Because of the unpredictable distortions caused by the thermoforming process, it is not practical to make the cuts prior to thermoforming. However, die cutting an internal opening in a thermoformed blister is typically an awkward and troublesome process that requires specialized off-line tooling and equipment because of the blister's three-dimensional shape. Internal die cutting and stripping are usually done with an expensive two-level die cutting machine or a punch and die set. Using a cutting machine to make a cutout or opening in a side panel of a thermoformed blister has proven to be especially difficult. In addition, in order to indicate the area to be die cut, a thermoformed blister often contains a guide rail, which tends to complicate and distort the face panel, detracting from the esthetic appearance of the finished package.

SUMMARY OF THE INVENTION

These and other issues raised by the prior art are addressed by the present invention, aspects of which provide a package in which an item is enclosed in a non-thermoformed blister-like compartment and methods for making the package. A blank is cut out of the sheet of plastic, the blank having a plurality of panels and flange sections such that the blank can be folded into a blister-like compartment having a flange at its base. The sheet of plastic from which the blank is cut may be printed on, coated, and/or decorated. The blank may also have cutout sections or perforations. The blank is then folded, without thermoforming, into a blister-like compartment and loaded with the item to be packaged. One way to seal the package is to affix a backing to the flange at the base of the blister-like compartment.

Additional features and advantages of the present invention will become apparent by reference to the following detailed description and accompanying drawings.

DETAILED DESCRIPTION

A first aspect of the invention provides a product package having a blister-like compartment that is fabricated from a sheet of plastic without the use of thermoforming. Because the blister-like compartment is not thermoformed, all of the techniques that are used to decorate, coat, print on, or make cutouts in rolls or individual sheets of plastic may be performed upon the sheet from which the blister-like compartment is fabricated, that is, prior to the forming of the compartment. Thus, for example, a high quality single-sheet lithographic printing process can be used to apply printing that can appear at any location on the blister-like compartment in the finished package. As mentioned above, it is typically only practical to print on the flat front panel of a thermoformed blister. Stamping of a blister-like compartment according to the present invention can be accomplished in-line. Further, a blister-like compartment according to the present invention can be readily die cut and stripped, without the need for specialized die cutting equipment. As described below, it is also possible to implement an "easy-open" feature in a blister-like compartment by making suitable perforations or scores in the sheet of plastic from which the compartment is fabricated.

Another advantage of the present invention over traditional blister packages is that the blister-like compartment is formed from a flat, essentially two-dimensional blank that can be fed directly into a loading and sealing machine. As mentioned above, in the manufacturing of a traditional blister package, a three-dimensional thermoformed blister is typically fed into the loading and sealing machine. The use of a flat blank has a number of advantages over the prior art. First, flat blanks stack at maximum density, significantly decreasing the amount of space required for transportation and storage. Second, because the blanks are flat, the risk of nesting is completely eliminated. There is thus no longer a need for de-nesting lugs that may detract from the overall esthetic appearance of the package.

Figure 1:
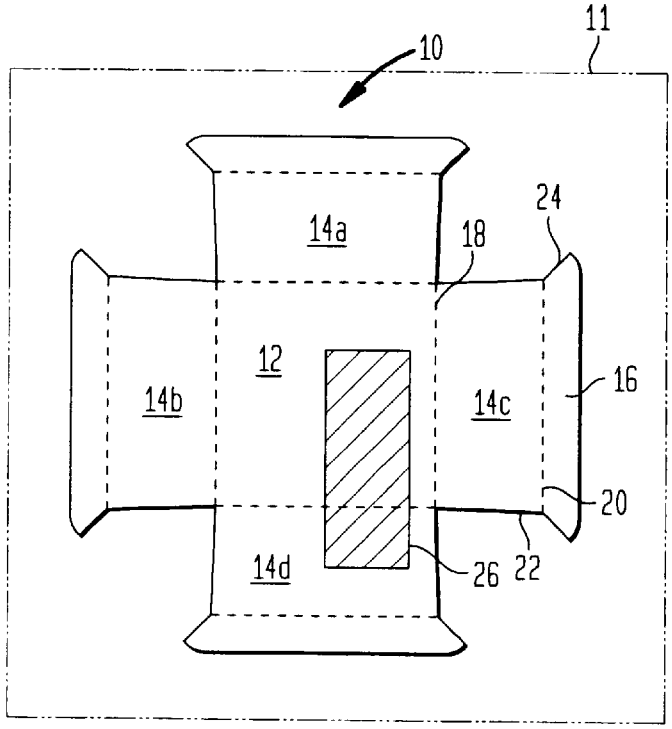
FIG. 1 shows an elevation view of a blank used to form a blister-like compartment in accordance with a first aspect of the present invention.

FIG. 1 shows an elevation view of a first embodiment of a blank 10, from which a blister-like compartment is formed in accordance with an aspect of the present invention. The blank 10 is cut from a single sheet or a bulk roll of a suitable plastic material 11 (shown in broken lines), including but not limited to such materials as polypropylene, polyvinyl chloride (PVC) amorphous polyethylene terephalate (APET) or polyethyleneterephthalateglycolate (PETG). It should be noted that in FIG. 1, the plastic material 11 from which the blank 10 is cut is shown as a rectangle for purposes of illustration. In practice, the material 11 may be any shape that is suitable for receiving decoration, printing, or coating, or other suitable techniques as described herein.

Either side of the sheet 11 from which the blank 10 is cut may be printed on by using a suitable printing technique performed on the sheet or roll of plastic material 11. For purposes of illustration, FIG. 1 shows a rectangular shaded portion 26, representing a printed portion of the plastic material 11. (As used herein, the terms "print," "printed," "printing," and "printing technique" include all techniques used to apply text, graphics, designs, decorations, or coatings onto a plastic material.) It is contemplated that the printing or coating of the plastic material 11 will be accomplished using a high-speed process. Of course, if desired, it would also be possible to print on or decorate the blank using a less efficient process without departing from the spirit of the invention.

According to a further aspect of the invention, the plastic material 11 used to fabricate the blister-like compartment is see-through, that is, the packaged item is visible from the outside of the finished package through non-printed portions of the blister-like compartment. Thus, it is contemplated that in printing onto the plastic, certain portions of the plastic will typically remain blank to allow some or all of the packaged item to remain visible in the finished package. Of course, in certain special situations, it may be desirable to print on all, or virtually all, of the available area on the panels and flanges of the blister-like compartment.

After the sheet or roll of plastic material 11 has been printed on, the blank 10 is cut from the sheet of plastic material 11. One suitable technique for cutting the blank is to use a die cutting machine, in which all the cuts are made simultaneously by urging cutting blades that have been suitably positioned on a cutting die through the sheet of plastic. If it is desired to provide cutout sections in the finished blister-like compartment, those cutout sections can be cut at the same time that the blank is cut from the sheet of plastic. In addition, any desired score lines or perforations may also be fabricated into the blank at this manufacturing stage. One suitable technique for scoring PVC or PETG is "soft creasing," in which score lines are created by exposing the plastic to a radio frequency electromagnetic signal that alters the molecular structure of the plastic, producing a score line. Another scoring technique, known as "microperfing," is suitable for use with polypropylene or APET. Using a microperfing technique, microscopic perforations are cut into the plastic along the score line by a suitably positioned blade in the cutting die. However, it will be appreciated that other scoring and cutting techniques may also be employed without departing from the spirit of the invention.

As shown in FIG. 1, the blank 10 includes a front panel 12 and four secondary panels: a top panel 14*a*, a left side panel 14*b*, a right side panel 14*c*, and a bottom panel 14*d*. The secondary panels 14*a–d* extend from the front panel 12, and a number of flange sections 16 extending from the secondary panels 14*a–d*. The front panel 12 is separated from the secondary panels 14*a–d* by a first set of score lines 18, and the secondary panels 14*a–d* are separated from the flange sections 16 by a second set of score lines 20. The front panel 12, secondary panels 14*a–d*, and flange sections 16 are shaped such that they can be folded along the score lines 18 and 20 to form a blister-like compartment having a flange at its base. The flange is used to adhere the compartment to a card or other surface.

Figure 3A:
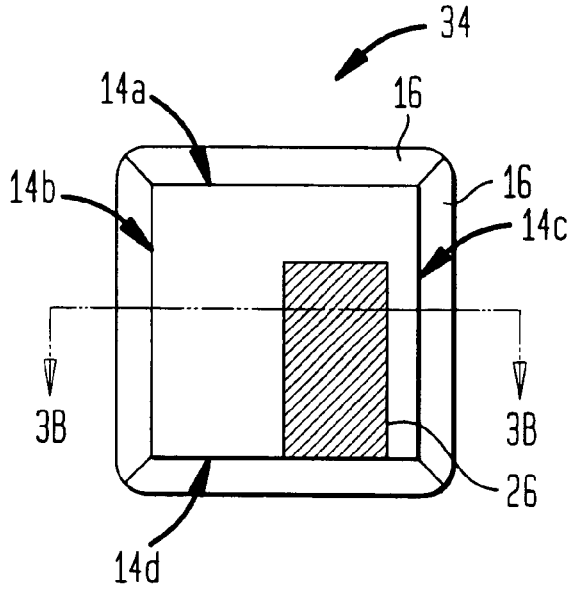
FIG. 3A shows an elevation view of a blister-like compartment formed from the blank shown in FIG. 1.
Figure 3B:
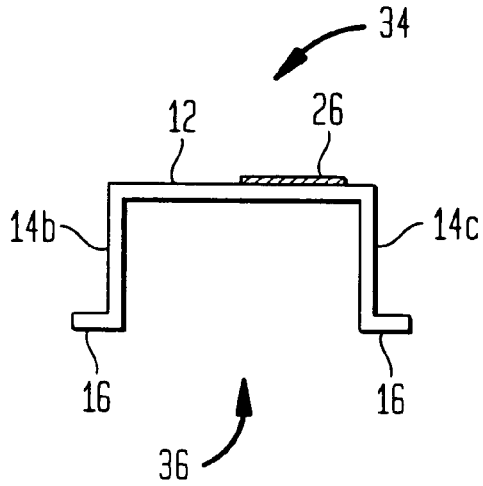
FIG. 3B shows a cross section of the blister-like compartment shown in FIG. 3A through the plane 3B—3B.

The blank 10 shown in FIG. 1 is designed to be folded into a box-shaped compartment. Thus, each of the secondary panels 14*a–d* is folded along a score line 18 towards the same side of the front panel 12, such that each of the secondary panels 14*a–d* is perpendicular to the front panel 12 and such that the lateral edges 22 of each of the secondary panels 14*a–d* abut those of the immediately adjacent secondary panels 14*a–d* on either side. (The blister-like compartment is illustrated in FIGS. 3A and 3B, discussed below.)

It should be noted that in some applications, it may be desirable for there to be an open gap between the lateral edges 22 of adjacent secondary panels 14*a–d*. In this case, the secondary panels 14*a–d* could be folded such that the angle between the front panel 12 and some or all of the secondary panels 14*a–d* is greater than 90 degrees.

The flange sections 16 are folded along score lines 20 so that they are perpendicular to the secondary panels 14*a–d*. In the blank 10 shown in FIG. 1, the flange sections 16 are designed to be folded towards the exterior of the blister-like compartment. In addition, the flange sections 16 have beveled lateral edges 24 that are angled such that when the blank has been folded along the first set of score lines 18 and the second set of score lines 20, the flange sections' lateral edges 24 abut each other forming a substantially continuous flange that is used to adhere the blister-like compartment to a backing, such as a card. Also, the outer perimeter of each flange section in the blank 10 shown in FIG. 1 includes an optional curved portion 26 that is used to provide an esthetically pleasing contour in the finished package.

It would also be within the spirit of the present invention to design flange sections 16 some or all of which can be folded towards the interior of the blister-like compartment. This would be useful, for example, where it is desired to fabricate a package that can stand on a counter. In such a design, the blister-like compartment would be positioned on a card such that one of the side panels 14 is flush with a bottom edge of the card to allow the package to be stood on its side. (As illustrated in FIGS. 14A–B and 15A–B, discussed below, it is also possible to fabricate a standable package using a "foot" that extends downward from the front panel of the blister-like compartment.)

It should be noted that it is not practical to employ this technique to design a standable carton using a thermoformed blister. First, unlike a blister-like compartment according to the present invention, a thermoformed blister cannot, as a practical matter, be designed with side panels that are perpendicular with the front panel. In a thermoformed blister, the angle between the side panels and the front panel must be greater than 90 degrees to allow the blisters to be stacked one inside the other. Further, in order to allow the thermoformed blister to be released from the forms used to shape the blister, the flange in a thermoformed blister cannot extend towards the interior of the blister.

Figure 2:
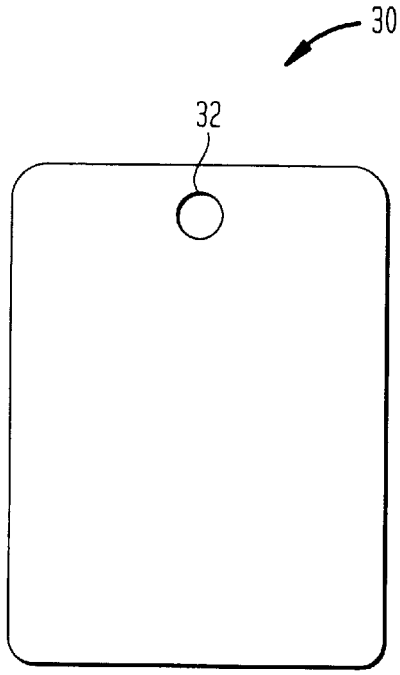
FIG. 2 shows an elevation view of a card that can suitably be combined with the blank illustrated in FIG. 1 to fabricate a package according to the present invention.

FIG. 2 shows an elevation view of a card 30 that can be used with the blank 10 shown in FIG. 1 to fabricate a package having a blister-like compartment according to the present invention. The card 30 is fabricated from cardboard, plastic, or other suitable material, and may be printed on prior to assembly into the finished package. In the present embodiment of the invention, the card 30 is coated with a heat-sealing material for adhesion to the blister-like compartment. At room temperature, the coating of the card 30 is non-adhesive. However, under suitable temperature and pressure conditions, the coating of the card 30 can form a permanent adhesive bond with the flange sections 16 of the blank 10. Of course, it would be possible to practice the present invention using other types of adhesion and adhesive materials. Also, it would be possible to apply the heat-sealing material to the flange sections 16 instead of to the card 30, or both to the card 30 and to the flange sections 16. The top of the card 30 is provided with a hole 32 that is used to hang the finished carton on a display rod or hook.

FIG. 3A shows an elevation view of a blister-like compartment 34 that has been formed from the blank 10 shown in FIG. 1, and FIG. 3B shows a cross section of the blister-like compartment through the plane 3B—3B. As shown in FIGS. 3A and 3B, the blister-like compartment 34 includes a front panel 12 and secondary panels 14*a–d* which, as shown in FIG. 3B, define an enclosure with a mouth 36 at its base. The flange sections 16 have joined together to form a flange around the perimeter of the mouth 36.

Figure 4A:
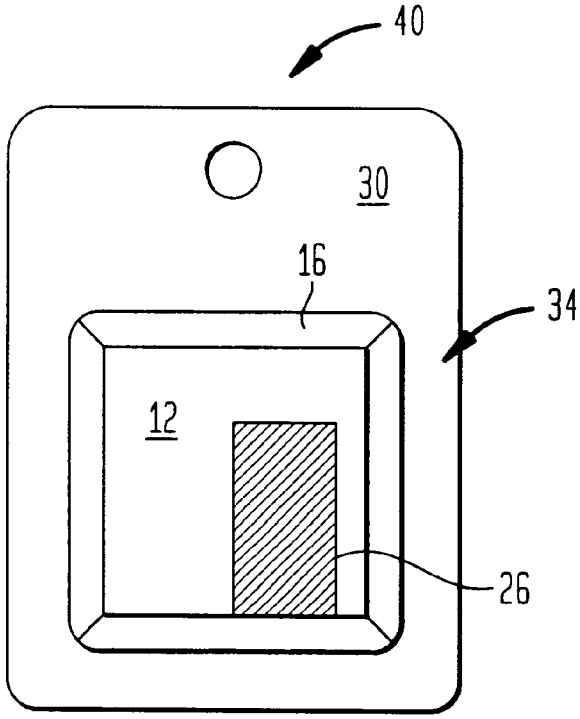
FIG. 4A shows an elevation view of a finished package assembled from the blank and card illustrated in FIGS. 1 and 2.
Figure 4B:
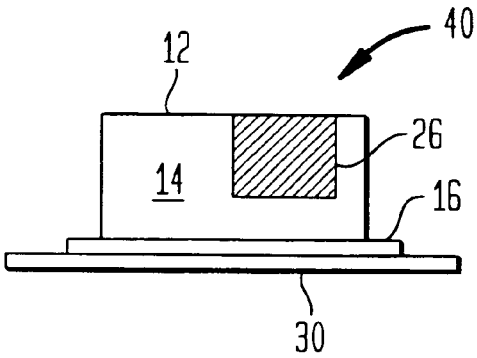
FIG. 4B shows a bottom view of the package illustrated in FIG. 4A.

FIG. 4A shows an elevation view of a finished package 40 fabricated from the blister-like compartment 34 shown in FIGS. 3A and 3B, using the card 30 shown in FIG. 2 as a backing. FIG. 4B shows a bottom view of the package 40. In the exemplary embodiment of the invention shown in FIGS. 4A and 4B, the printed portion 26 straddles the front panel 12 and one of the side panels 14. However, it will be apparent that printing may appear on any of the panels 12 and 14*a–d* and flange sections 16, as desired, without departing from the spirit of the present invention. It should be noted that the blister-like compartment 34 can be adhered to any desired position on the card 30. It should also be noted that, as mentioned above, the heat-sealing material may be applied to the card 30, to the flange sections 16, or both. In the case of a thermoformed blister according to the prior art, the heat-sealing material can typically only be applied to the card.

Figure 10A:
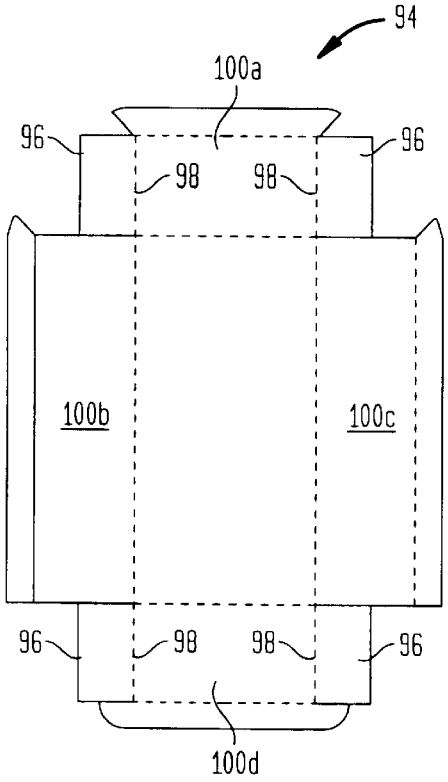
FIG. 10A shows an elevation view of a blank, according to a further aspect of the present invention, that is used to form a blister-like compartment in which seams between adjacent panels are covered by flaps.
Figure 10B:
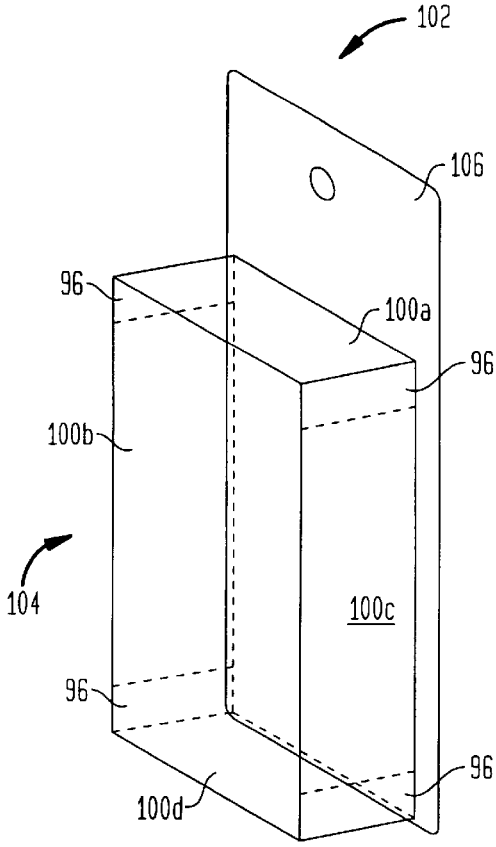
FIG. 10B shows a perspective view of a finished package fabricated using the blank shown in FIG. 10A.

The finished package 40 shown in FIGS. 3 and 4 resembles a thermoformed blister package with a couple of notable differences, beyond any decoration or other printing appearing on the blister-like compartment 34. First, in the present embodiment of the invention, the blister-like compartment 34 has open seams between each of the side panels 14, where their outer edges 22 meet. However, if the blank has been carefully cut, folded, and adhered into position, the open seams are generally unnoticeable to a casual observer. It would be possible to close these seams without departing from the spirit of the present invention. For example, as illustrated in FIGS. 10A and 10B, described below, it is possible to incorporate flaps into a blank that, when the blank is formed into a blister-like compartment, are folded over the seams to close them. Second, as mentioned above, the secondary panels 14*a–d* of the blister-like compartment 34 are perpendicular to the front panel 12. As mentioned above, it is impractical to design a thermoformed blister this way because of the need to allow the thermoformed blister to be stacked one inside the other. Thus, the blister-like compartment 34 has a crisper, squarer look than a thermoformed blister. Further, also as mentioned above, the esthetic appearance of the blister-like compartment 34 is not marred by the presence of any de-nesting lugs.

It will be appreciated that the present invention may be used to fabricate packages with blister-like compartments having a wide variety of shapes and configurations, depending upon the design of the compartment blanks and the positioning of the compartments on the backing cards. Examples of various blank shapes are shown in FIGS. 5A, 6A, 7A, 8A, and 9A. Finished packages fabricated from these blanks are shown, respectively, in FIGS. 5B, 6B, 7B, 8B, and 9B. It should be noted that these blanks and packages are provided for purposes of illustration. It will be apparent that the present invention may also be practiced using other designs beyond those illustrated herein.

Figure 5A:
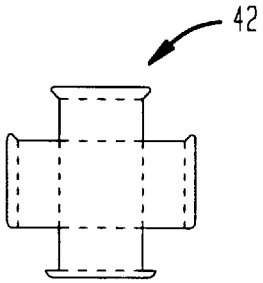
FIG. 5A shows an elevation view of an alternative design for a blank according to the present invention
Figure 5B:
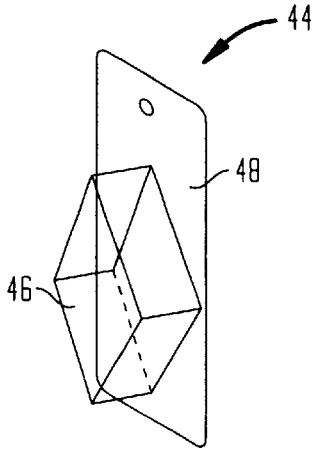
FIG. 5B shows a perspective view of a finished package fabricated using the blank shown in FIG. 5A.

FIG. 5A shows an elevation view of a blank 42 similar in shape to the blank 10 shown in FIG. 1. FIG. 5B shows a perspective view of a finished package 44 having a blister-like compartment 46 that has been formed from the blank 42 and then mounted to a card 48. As shown in FIG. 5B, the blister-like compartment 46 has been mounted to the card 48 at an angle to create a different appearance.

Figure 6A:
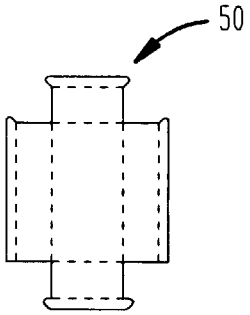
FIG. 6A shows an elevation view of a further alternative design for a blank according to the present invention.
Figure 6B:
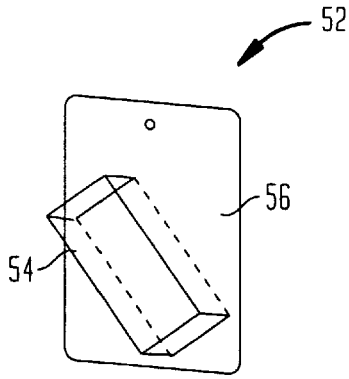
FIG. 6B shows a perspective view of a finished package fabricated using the blank shown in FIG. 6A.

FIG. 6A shows an elevation view of a blank 50 that is somewhat longer and narrower than the blank 10 shown in FIG. 1. FIG. 6B shows a perspective view of a finished package 52 having a blister-like compartment 54 that has been formed from the blank 52 and then mounted to a card 56. As shown in FIG. 6B, the blister-like compartment 54 has a rectangular shape and is mounted to the card 56 at an angle.

Figure 7A:
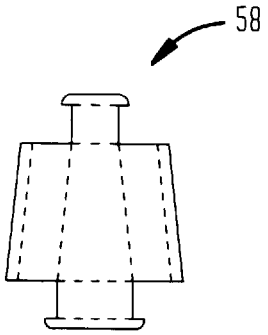
FIG. 7A shows an elevation view of a further alternative design for a blank according to the present invention.
Figure 7B:
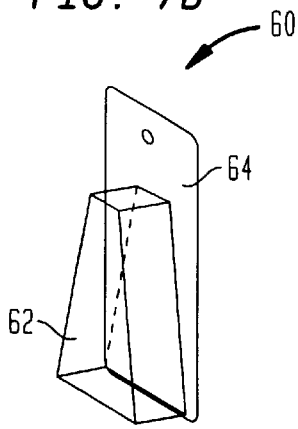
FIG. 7B shows a perspective view of a finished package fabricated using the blank shown in FIG. 7A.

FIG. 7A shows an elevation view of a blank 58 having a tapered profile. FIG. 7B shows a perspective view of a finished package 60 having a blister-like compartment 62 that has been formed from the blank 58 and then mounted to a card 64. As shown in FIG. 7B, the blister-like compartment 62 has a trapezoidal front panel.

Figure 8A:
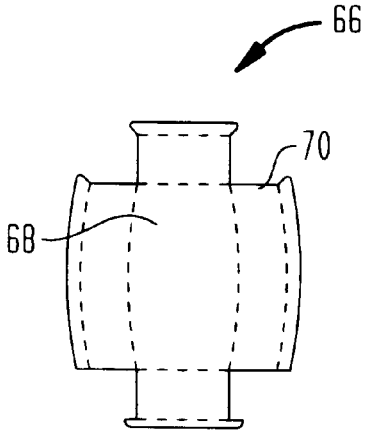
FIG. 8A shows an elevation view of a further alternative design for a blank according to the present invention.
Figure 8B:
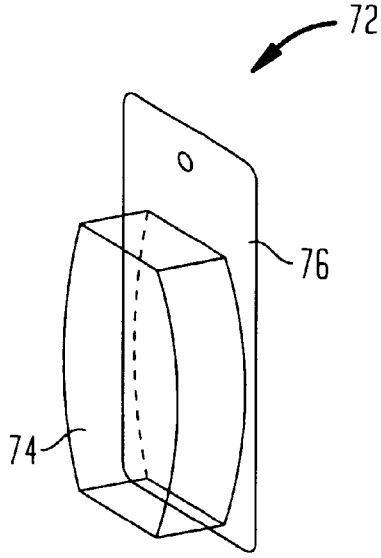
FIG. 8B shows a perspective view of a finished package fabricated using the blank shown in FIG. 8A.

FIG. 8A shows an elevation view of a blank 66 having a front panel 68 and side panels 70 with curved edges. FIG. 8B shows a perspective view of a finished package 72 having a blister-like compartment 74 that has been formed from the blank 66 and then mounted to a card 76. As shown in FIG. 8B, the blister-like compartment has convex side panels.

Figure 9A:
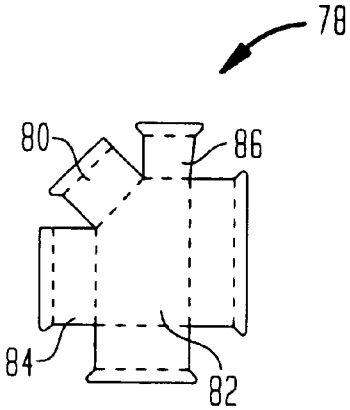
FIG. 9A shows an elevation view of a further alternative design for a blank according to the present invention.
Figure 9B:
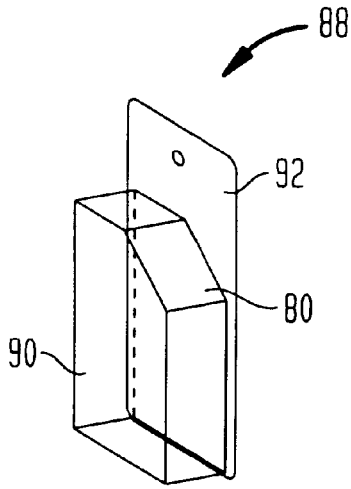
FIG. 9B shows a perspective view of a finished package fabricated using the blank shown in FIG. 9A.

FIG. 9A shows an elevation view of a blank 78 having an extra panel 80 projecting diagonally outward from the front panel 82 between a side panel 84 and the top panel 86. FIG. 9B shows a perspective view of a finished package 88 having a blister-like compartment 90 that has been formed from the blank 78 and then mounted to a card 92. As shown in FIG. 9B, the extra panel 80 in the blank 78 appears as a truncated corner of the blister-like compartment 90.

As mentioned above, in the finished package shown in FIGS. 4A and 4B, there are open seams at the corners of the blister-like compartment 42 where the side panels 14 meet. As further mentioned above, it is it possible to design a blank in accordance with the present invention in which these seams are covered. FIG. 10A shows a blank 94 having four flaps 96 that, in forming a blister-like compartment, are folded along score lines 98 such that in the finished package the flaps 96 abut the inner surface of the secondary panels 100*a–d*. The flaps may be used, for example, as a dust preventative or corner strengthening device. FIG. 10B shows a perspective view of a package 102 that has been fabricated from the blank 94, which has been formed into a blister-like compartment 104 and mounted onto a backing card 106. The flaps 96 may be sealed to the inner surface of the secondary panels 100*a–d* or may alternatively be left unsealed.

Figure 11A:
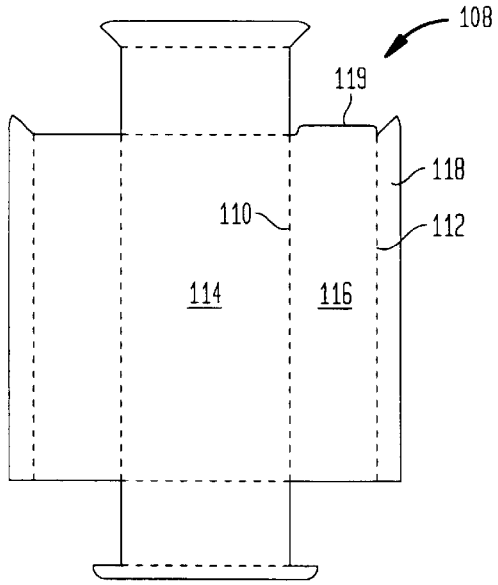
FIG. 11A shows an elevation view of a blank, according to a further aspect of the present invention, that is used to form a blister-like compartment having an easy-open feature.

As further mentioned above, the present invention may be used to implement an easy-open feature in the finished package. FIG. 11A shows a blank 108 incorporating an example of an easy-open feature. The blank 108 includes two perforations 110 and 112. The first perforation 110 lies along the score line between the front panel 114 and a side panel 116. The second perforation 112 lies on the score line between the side panel 116 and the contiguous flange section 118. These perforations 110 and 112 may be cut into the blank 108 as part of the process of cutting the blank 108 out of a sheet of plastic. It will be seen that the portion of the side panel 116 lying between the perforations 110 and 112 functions as a tear strip. The top of the side panel 116 is slightly extended to provide a finger grip 119 for the tear strip.

Figure 11B:
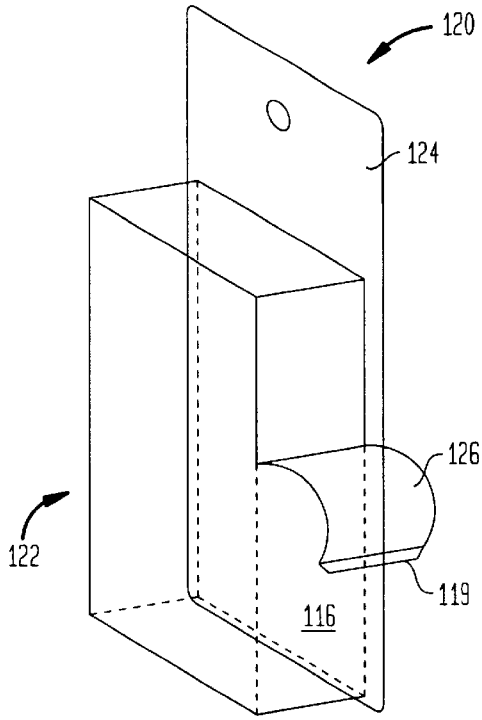
FIG. 11B shows a perspective view of a finished package fabricated using the blank shown in FIG. 11A.

FIG. 11B shows a perspective view of a finished package 120 that has been fabricated from a blister-like compartment 122 that has been formed from the blank 108 and mounted to a backing card 124. As shown in FIG. 11B, the tear strip 126 has been partially pulled away from the blister-like compartment 122 by breaking the perforations, thereby exposing the interior of the blister-like compartment 122, and allowing access to the product contained with the compartment 122. If desired, instructions as to how to open the finished package 120 using the easy-open feature may be printed directly onto the blister-like compartment 122 or onto the backing card 124.

It should be noted that conventional blisters are commonly provided with perforations on the backing card to facilitate opening the package. These perforations can be unreliable, resulting in irregular tearing of the card and making the opening of the package difficult. By way of contrast, the perforation technique illustrated in FIGS. 11A and 11B can be used to locate perforations at any desired location on the blister-like compartment 122. This is desirable because plastic typically tears more cleanly than cardboard.

Figure 12A:
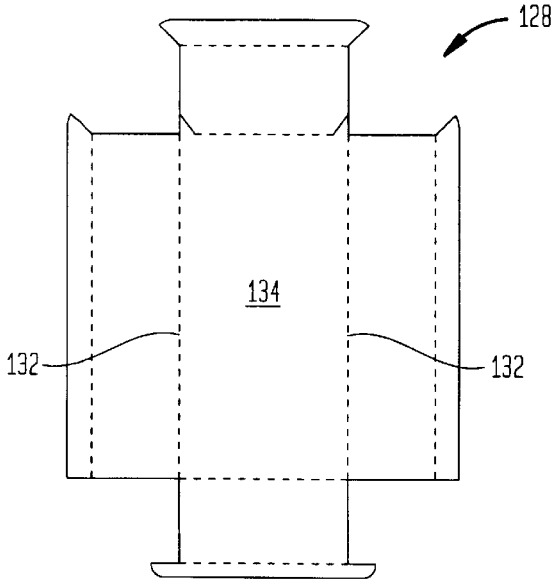
FIG. 12A shows an elevation view of an alternative embodiment of a blank used to form a blister-like compartment having an easy-open feature.
Figure 12B:
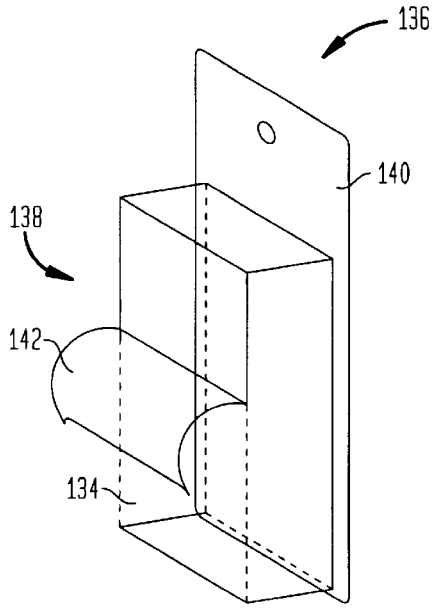
FIG. 12B shows a perspective view of a finished package fabricated using the blank shown in FIG. 12A.

FIG. 12A shows an elevation view of a blank 128 in which the perforations 130 and 132 are located on either side of the front panel 134. Thus, in essence, the entire front panel 134 becomes a tear strip. FIG. 12B shows a perspective view of a finished package 136 having a blister-like compartment 138 formed from the blank 128 that has been mounted to a backing card 140. In FIG. 12B, the upper portion 142 of the front panel 134 has been tom away from the blister-like compartment along the perforations. The entire panel 134 can be tom away or, if desired, the panel 134 can be perforated such that only a partial area of the panel 134 is torn away. This could be used, for example, to create a dispenser. If desired, the top of the panel 134 may be extended to provide a finger grip, similar to the finger grip 119 shown in FIGS. 11A and 11B.

Figure 13A:
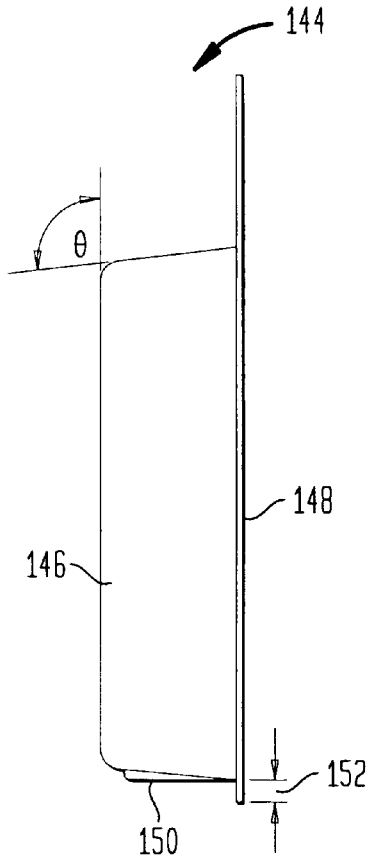
FIG. 13A shows a side view of a thermoformed blister package according to the prior art, in which a foot has been added to blister in an attempt to fabricate a standable package.
Figure 13B:
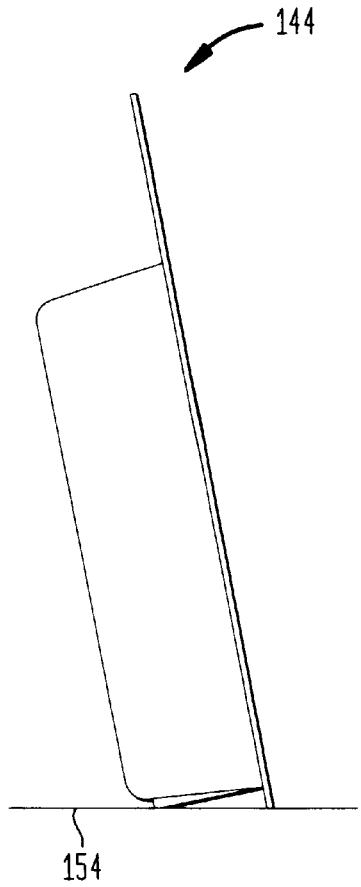
FIG. 13B shows a side view of the blister package shown in FIG. 13A, in which the package has been stood on end on a level surface.

As mentioned above, it is sometimes desirable to design a blister package that is standable, that is, that can be stood on one end of the blister. However, because of the thermoforming technique used to fabricate conventional blisters, the blister must include a draft angle of greater than 90° to allow the blister to be released from the forming device. FIG. 13A shows a side view of a conventional blister package 144 that includes a thermoformed blister 146 and a backing card 148. The draft angle is illustrated as angle θ. Attempts have been made to create a standable blister by forming a small foot 150 at the base of the blister 146. However, the angle of the foot 150 is limited to 90° or greater, again because of the thermoforming process. This is problematic. Because of the flange used to adhere the blister 146 to the card 148, there must be a small gap 152 between the bottom of the blister 146 and the bottom of the card 148. However, because the angle of the foot 150 is limited to 90° or greater, the foot 150 cannot be angled to bridge this gap 152. FIG. 13B shows a side view of the package 144 shown in FIG. 13A that has been placed onto a flat surface 154. As is apparent from FIG. 13B, even with the foot 150, the package has a tendency to tip forward and is easy to topple.

Figure 14A:
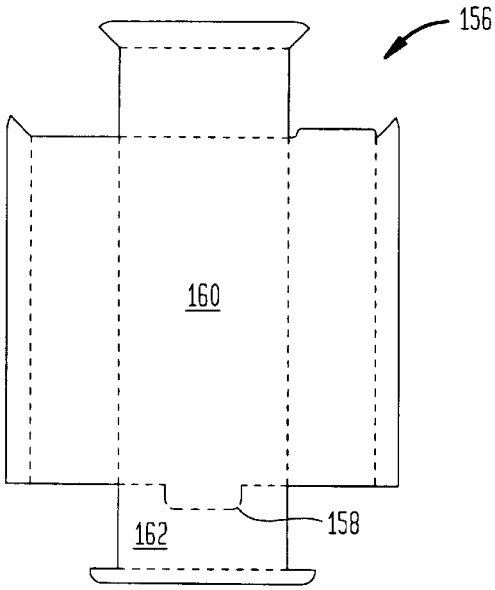
FIG. 14A shows an elevation view of a blank, according to a further aspect of the present invention, that is used to form a blister-like compartment having a foot to allow the package to be stood on end.
Figure 14B:
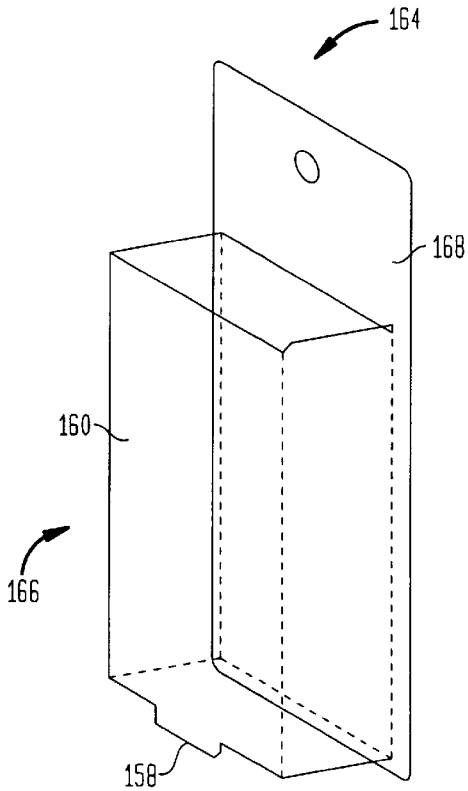
FIG. 14B shows a perspective view of a finished package fabricated using the blank shown in FIG. 14A.

FIG. 14A shows an elevation view of a blank 156 according to a further aspect of the present invention including a foot 158 that has been cut between the front panel 160 and 162. FIG. 14B shows a perspective view of a finished package 164 that has been fabricated from the blank 156 that has been formed into a blister-like compartment 166 and then mounted onto a backing card 168. As shown in FIG. 14B, when the bottom panel 162 is folded into position, the foot 158 extends downward from the front panel 160. It will be apparent that the blank 156 can be designed in such a way that the foot 158 is of the correct length to bridge any gap between the bottom panel 162 of the blister-like compartment 166 and the bottom of the backing card 168. Thus, when stood on end, the finished package 164 is level. If desired, it would also be possible to make the foot 158 slightly longer so that the finished package 164 tilts backward slightly when stood on end. This could be useful, for example, to provide stability for a package 164 containing a heavy item.

Figure 15A:
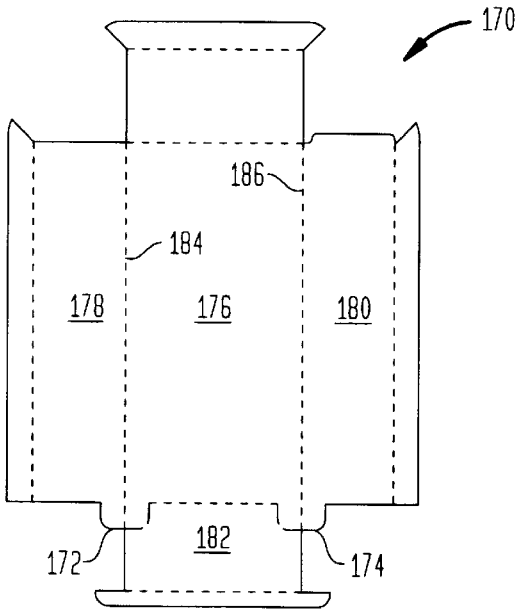
FIG. 15A shows an elevation view of an alternative embodiment of a blank, according to a further aspect of the present invention, that is used to form a blister-like compartment having a foot to allow the package to be stood on end.

FIG. 15A shows an elevation view of an alternative design for a blank 170 that can be used to create a standable package. The blank 170 includes a pair of feet 172 and 174. The left foot 172 is cut into the blank at the point where the front panel 176, left-side panel 178 and bottom panel 182 meet. The right foot 172 is cut into the blank at the point where the front panel 176, right-side panel 180 and bottom panel 182 meet. The feet 172 and 174 are oriented in the blank 170 such that when the blank 170 is formed into a blister-like compartment, the feet 172 and 174 project downward from the bottom corners of the front panel 176. As further illustrated in FIG. 15A, the score line 184 between the front panel 176 and the left-side panel 178 runs down the center of the left foot 172, and the score line 186 between the front panel 176 and the right-side panel 180 runs down the center of the right foot 174. Thus, it will be seen that when the blank 170 is formed into a blister-like compartment the right and left feet 172 and 174 will be folded along score lines 184 and 186. This increases the strength of the feet 172 and 174. However, it should be noted that it would also be possible, without departing from the spirit of the invention, to design a package with a pair of feet that are not folded.

Figure 15B:
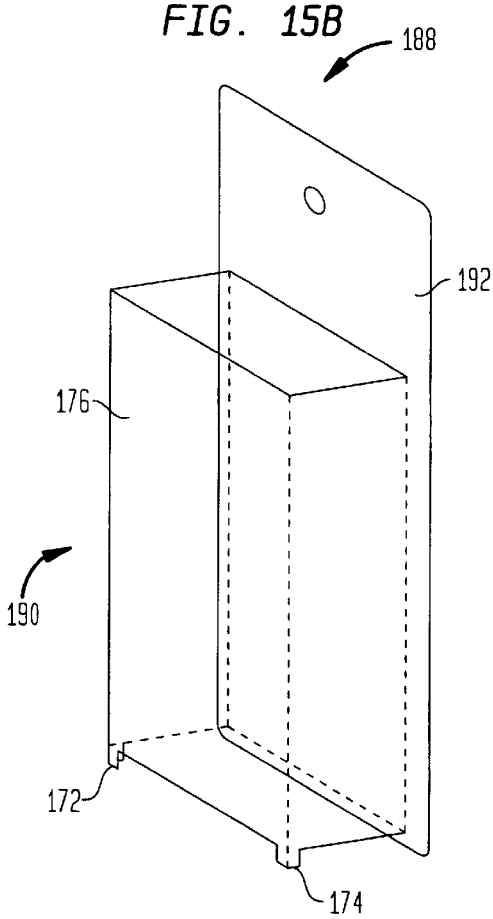
FIG. 15B shows a perspective view of a finished package fabricated using the blank shown in FIG. 14A.

FIG. 15B shows a perspective view of a finished package 188, which has been fabricated by forming the blank 170 into a blister-like compartment 190 and mounting it to a backing card 192. As shown in FIG. 15B, the feet 172 and 174 extend downward from the front panel 176 of the blister-like compartment 190 to level the package 188 when it is stood on end.

According to a further aspect of the invention, feet are used to provide a stackability feature in the finished package. FIG. 16A shows an elevation view of a blank 194 having a foot 196 cut into the blank 194 between the front panel 198 and the bottom panel 200 and a stacking tab 202 cut into the blank 194 between the front panel 198 and the top panel 204. FIG. 16B shows a side view of a finished package 206 that has been fabricated by forming the blank 194 into a blister-like compartment 208 and mounting it to a backing card 210. As shown in FIG. 16B, the foot 196 extends downward from the front panel 198, leveling the finished package when it is in an upright position. The stacking tab 202 extends upward from the front panel 198.

Figure 16C:
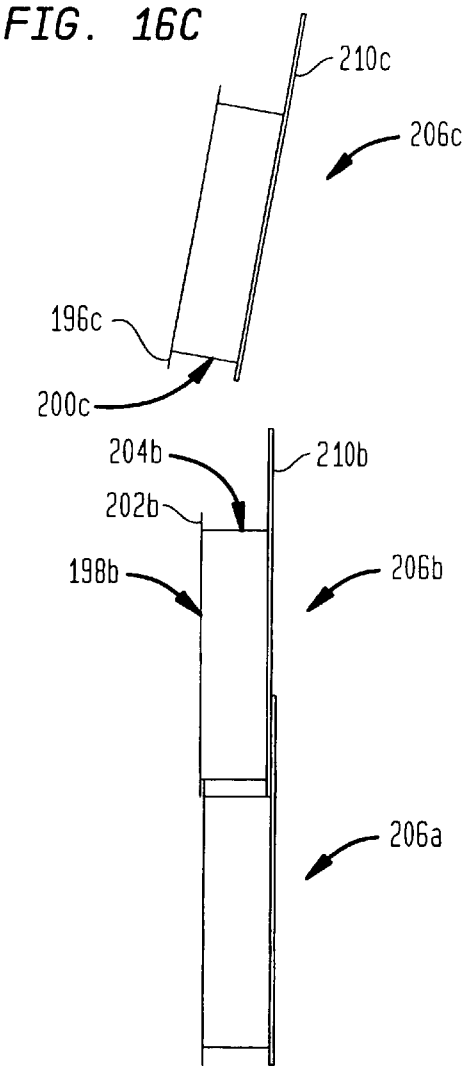
FIG. 16C shows a side view of three packages similar to the package shown in FIG. 16B that have been stacked end to end.
Figure 16B:
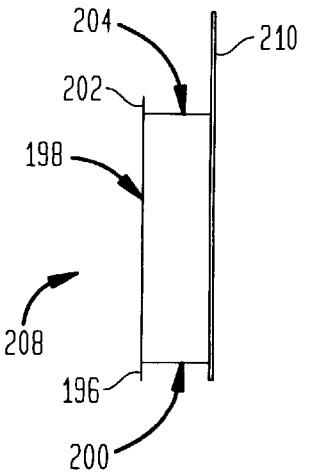
FIG. 16B shows a side view of a finished package fabricated using the blank shown in FIG. 16A.
Figure 16A:
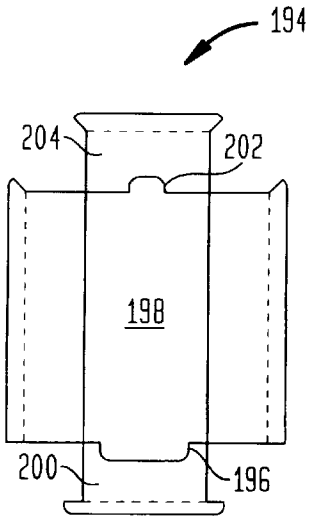
FIG. 16A shows an elevation view of a blank, according to a further aspect of the present invention, that is used to form a blister-like compartment having a stackability feature.

FIG. 16C shows a side view of three finished packages 206*a*, 206*b* and 206*c* that have been arranged to illustrate the stackability feature. The bottom package 206*a* is resting on a level surface (not shown). The middle package 206*b* is stacked on top of the bottom package 206*a*. The top package 206*c* has been partially removed from the stack for purposes of illustration. As shown in FIG. 16C, the top package 206*c* is stacked on top the middle package 206*b* by positioning the top package 206*c* on top of the middle package 206*b* with the top package's backing card 206*c* resting on the middle package's top compartment panel 204*b*, such that the rear surface of the top package's backing card 206*c* abuts the front surface of the middle package's backing card 206*b*. At the same time, the top package's bottom compartment panel 200*c* rests on top of the middle package's stacking tab 202*b*, such that the rear surface of the top package's foot 196*c* abuts the front surface of the middle package's stacking tab 202*b*. It will be apparent that other designs can be used to implement a stackability feature without departing from the spirit of the invention.

Figure 17A:
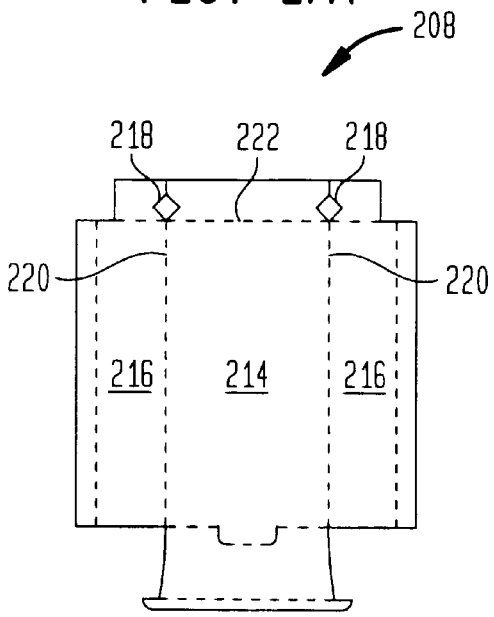
FIG. 17A shows an elevation view of a blank, according to a further aspect of the invention, that can be used to fabricate a finished package having a plurality of blister-like compartments.
Figure 17B:
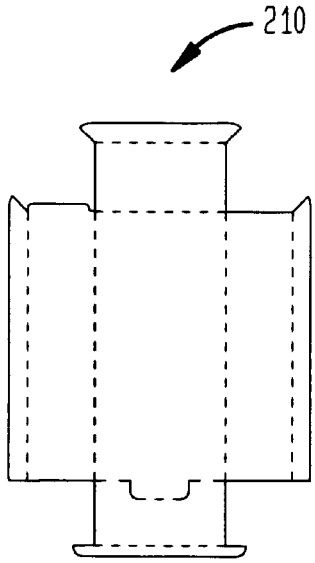
FIG. 17B shows an elevation view of a second blank that can be used in conjunction with the blank shown in FIG. 17A to fabricate a finished package having a plurality of blister-like compartments.

According to a further aspect of the invention, it is also possible to fabricate a single package having a plurality of blister-like compartments. FIGS. 17A and 17B show elevation views of two blanks 208 and 210. It should be noted that the blank 208 shown in FIG. 7A is designed to be formed into a blister-like compartment having an open top with a finished, reinforced border. Thus the blank 208 includes a finishing strip 212 that, in forming a blister-like compartment, is folded such that it abuts the inner surfaces of the front panel 214 and two side panels 216. In order to allow the finishing strip 212 to lie flush against the front and side panels without material gathering at the corners, two diamonds 218 have been cut into the finishing strip 212. These diamonds 218 may also serve an esthetic function in the finished package. Shapes other than diamonds 218 may be used without departing from the spirit of the present invention. The finishing strip 212 has a primary score line 222 that is used to fold the strip 212 such that it abuts the front and side panels 214 and 216. The finishing strip also has a pair of secondary lines 220 for folding the strip into a box shape in the interior of the blister-like compartment. As shown in FIG. 17A, each diamond 218 is cut into the strip such that lies along a secondary score line 220, and such that it has a vertex abutting the primary score line 222. This arrangement allows the blister-like compartment in the finished package to have sharp corners.

Figure 17C:
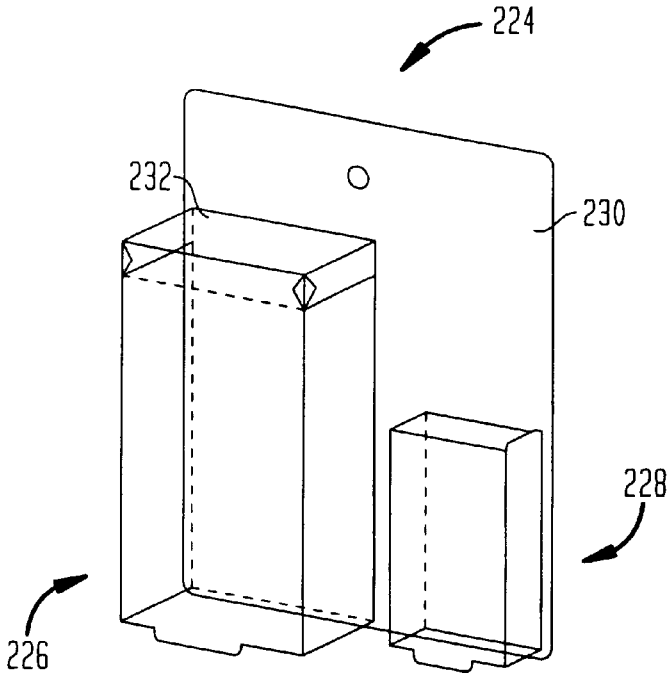
FIG. 17C shows a perspective view of a finished package fabricated using the blanks shown in FIGS. 17A and 17B.

FIG. 17C shows a perspective view of a finished package 224 that has been fabricated by forming the two blanks 208 and 210 into two blister-like compartments 226 and 228 and mounting them onto a backing card 230. Although the two compartments 226 and 228 are show mounted side to side, they may be arranged in any number of configurations without departing from the spirit of the present invention. As mentioned above, the compartment 226 formed from the blank 208 shown in FIG. 17A has an opening 232 instead of a top panel.

Figure 18A:
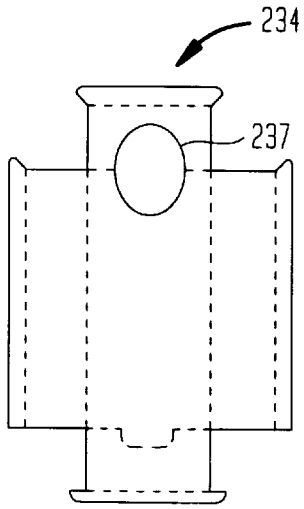
FIG. 18A shows an elevation view of a blank, according to a further aspect of the invention, that is used to form a finished package having a blister-like compartment having a cutout section therein.
Figure 18B:
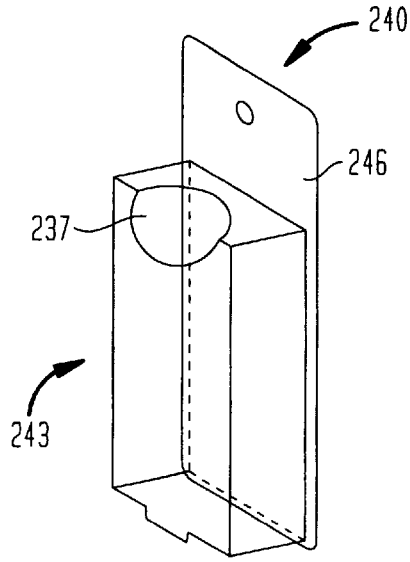
FIG. 18B shows a perspective view of a finished package fabricated using the blank shown in FIG. 18A.
Figure 19A:
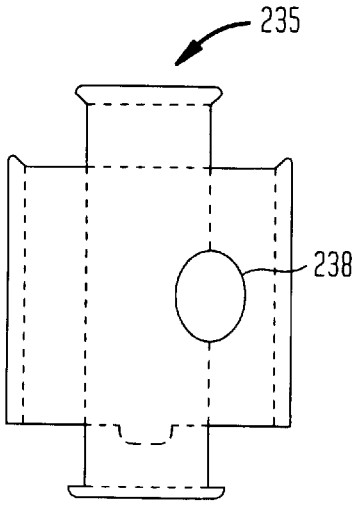
FIG. 19A shows an elevation view of an alternative embodiment of a blank that can be formed into a blister-like compartment having a cutout section therein.
Figure 19B:
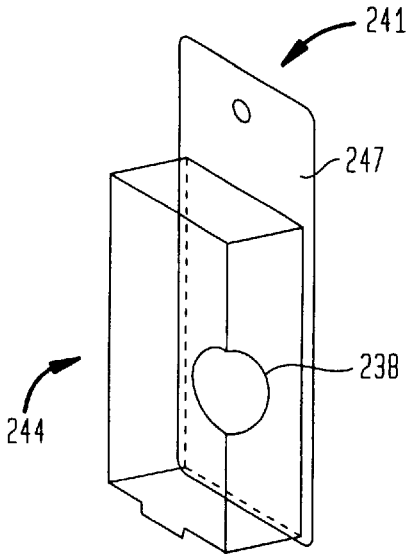
FIG. 19B shows a perspective view of a finished package fabricated using the blank shown in FIG. 19A.
Figure 20A:
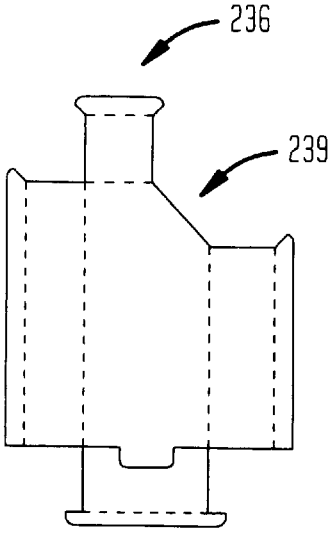
FIG. 20A shows an elevation view of a further embodiment of a blank that can be formed into a blister-like compartment having a cutout section therein.
Figure 20B:
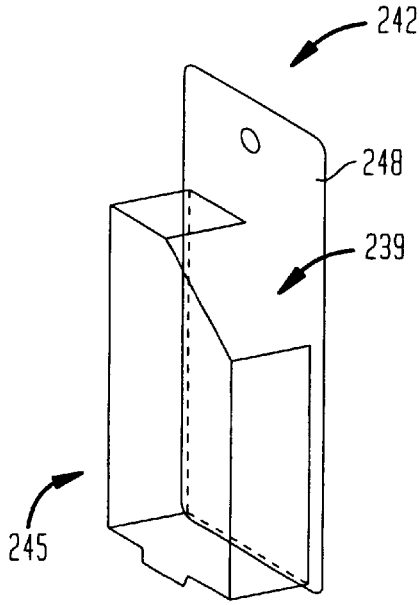
FIG. 20B shows a perspective view of a finished package fabricated using the blank shown in FIG. 20A.

As mentioned above, a further aspect of the invention is directed to a package having a blister-like compartment with one or more cutout sections. In one embodiment of the invention, each of the cutout sections is cut out of a blank prior to being formed into the blister-like compartment. FIGS. 18A, 19A and 20A show elevations views of blanks 234, 235, and 236 having respective cutout sections 237, 238, and 239. FIGS. 18B, 19B, and 20B show perspective views of finished packages 240, 241 and 242 that have been fabricated, respectively, by forming blanks 234, 234, and 236 into blister-like compartments 243, 244, and 245, and mounting the compartments onto backing cards 246, 247, and 248.

As shown in FIGS. 18B and 19B, a cutout section may straddle the front and top compartment panels (FIG. 18B) or the front and side compartment panels (FIG. 19B). As shown in FIG. 20B, a cutout section may also be shaped as a truncated corner. Because the blister-like compartment is formed without heat from a blank that is cut from a plastic sheet, it is possible to position cutout sections anywhere on the blister without additional tooling costs. These cutout sections can function, for example, as touch, access, or product locator holes. It should be noted that the depicted cutout sections are shown for purposes of illustration only and are not intended to limit the scope of the present invention. It will be apparent that various cutout designs can be used without departing from the spirit of the present invention.

One feature of the present invention is that it lends itself to the types of automated and semi-automated processes that are currently used to load and seal thermoformed blister packages. For example, as described in detail below, it is possible to use a Koch turntable machine, KDT-NP-1000/4/50(70), which has been modified in accordance with a further aspect of the invention, to form, load, and seal packages similar to the packages described above and illustrated in FIGS. 1–20B. Thus, it is possible to form, load, and seal packages having non-thermoformed blister-like compartments in substantially the same amount of time that is required to load and seal packages having thermoformed blisters.

Figure 21A:
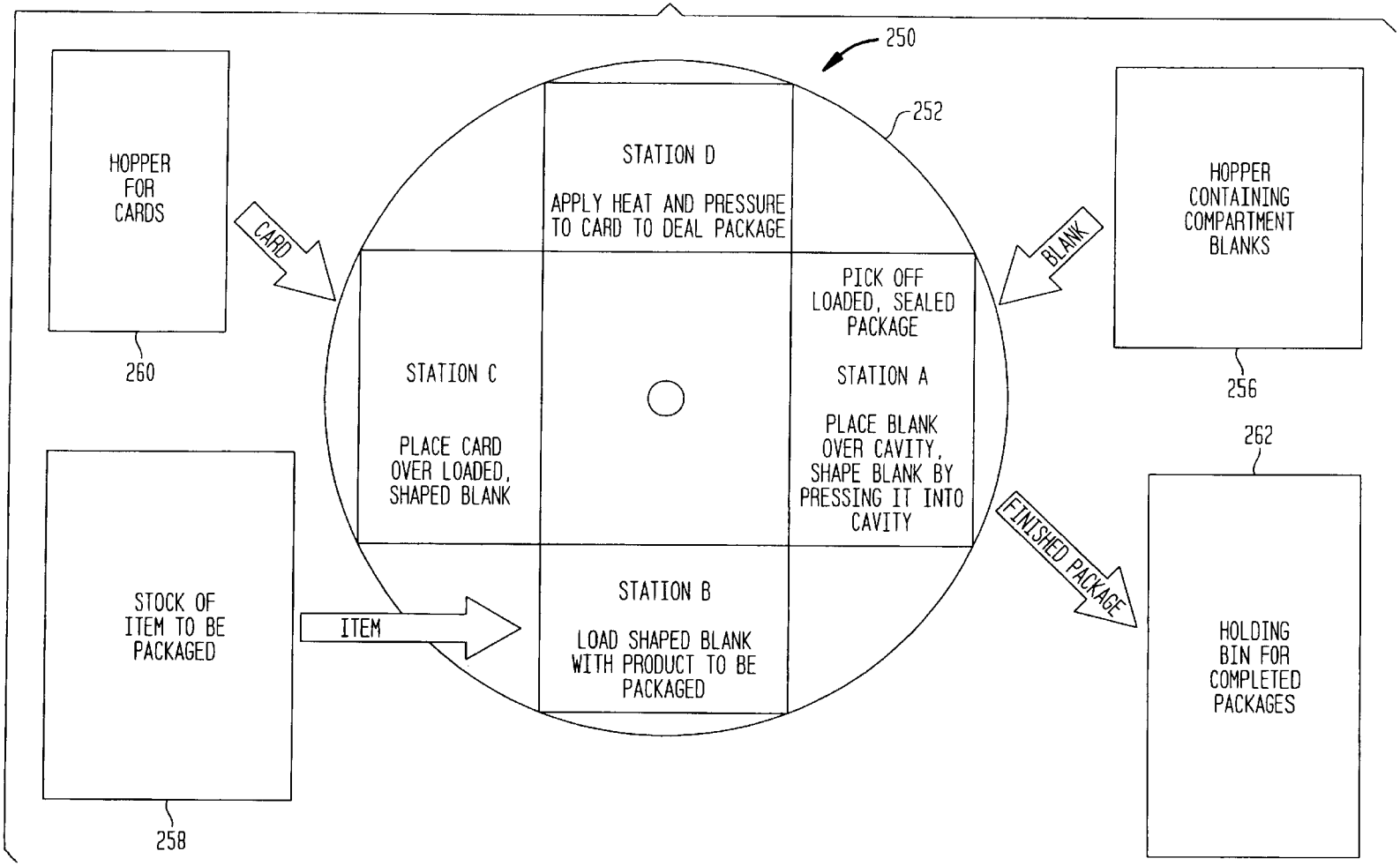
FIG. 21A shows a diagram of a turntable machine according to a further aspect of the invention for forming, loading, and sealing a product package having a blister-like compartment.

FIG. 21A shows a diagram of a turntable machine 250 that has been modified in accordance with a further aspect of the present invention. As its name implies, a turntable machine 250 uses a turntable 252 to move a package through the various stages of the assembly process. As shown in FIG. 21A, the turntable machine 250 is configured to include four separate stations, identified for the purposes of discussion as Station A through Station D.

Figure 21B:
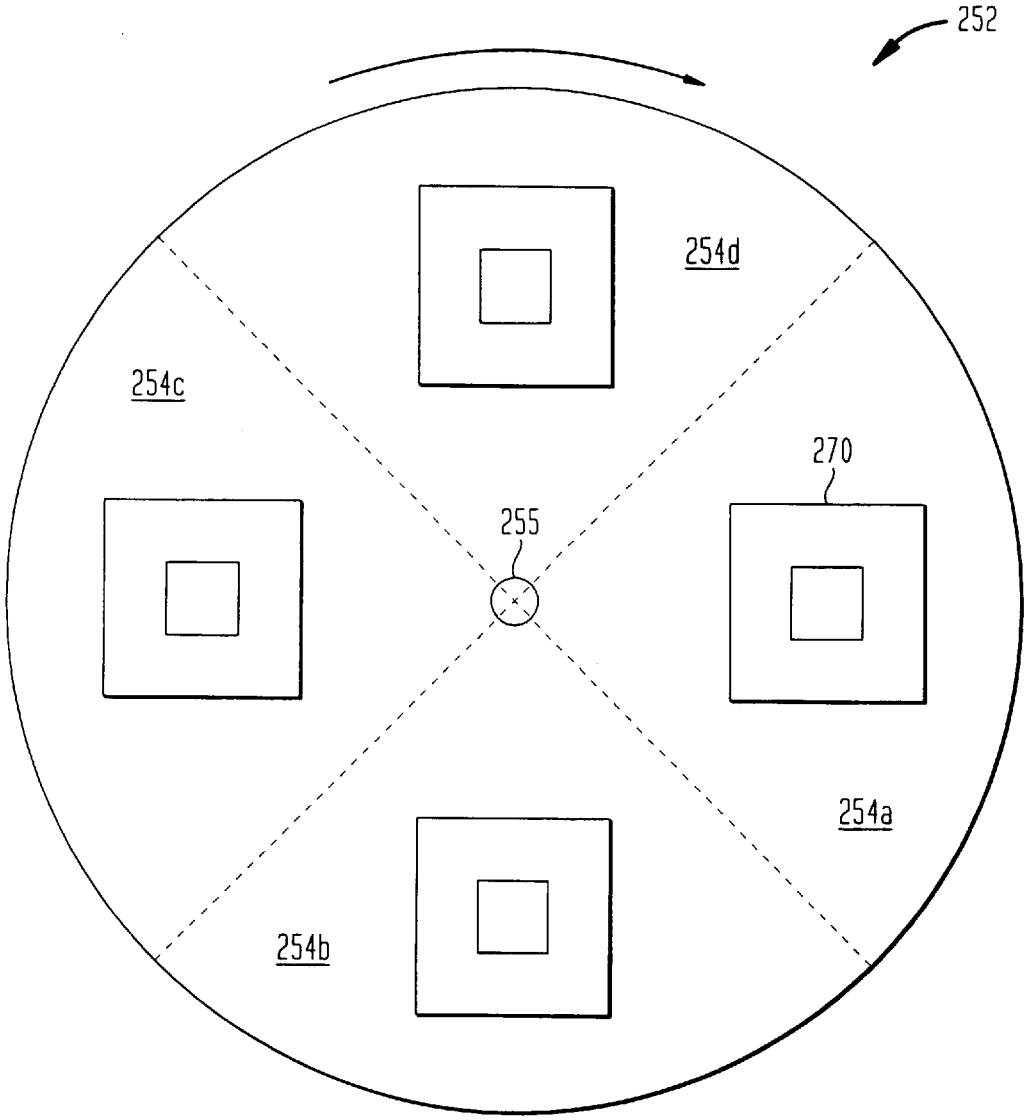
FIG. 21B shows a diagram of a turntable for use in the turntable machine illustrated in FIG. 21A, including four bases mounted thereon.

FIG. 4B shows a diagram of the turntable 252, which includes four quadrants 254*a*–*d*. Each quadrant has mounted therein a base 270 having a cavity 272 for forming and holding a blister-like compartment, as described in greater detail below. At regular intervals, the turntable 252 rotates a quarter turn around its central axis 255 in the indicated direction, causing each base and its contents to advance to the next station in the assembly process. This allows the four stations to be operated simultaneously on four separate packages that are at various stages of completion. A brief summary of the operations performed at the four stations is provided, with reference to FIGS. 21A and 21B, followed by a more detailed explanation.

Station A: A blank is removed from a hopper 256 and positioned onto a base 270 over a cavity 272. The blank is then folded into the shape of the final compartment by pressing the blank against the interior walls of the cavity 272. The blank remains seated in the cavity 272 for the remainder of the loading and sealing process.

Station B: The item to be packaged is removed from a stock 258 and then loaded into the folded blank. This process may be performed automatically by a loading machine or may also be performed manually. As mentioned above, the blank is advanced automatically from station to station by the turntable 252, which makes a quarter-rotation at regular intervals. Thus, if the loading process is performed manually, the worker must keep up with the movement of the turntable 252.

Station C: A card is removed from a hopper 260 and positioned over the loaded compartment. As mentioned above, in the present embodiment of the invention, the card has a heat-sealing coating.

Station D: A press applies heat and pressure to the card, causing an adhesive bond to form between the card and an adhesive flange on the loaded compartment.

Station A: The finished package is lifted out of the cavity and placed into a completion bin 262. A fresh blank from the hopper 256 is then positioned onto the now-vacant base 270 to start another production cycle.

Figure 22A:
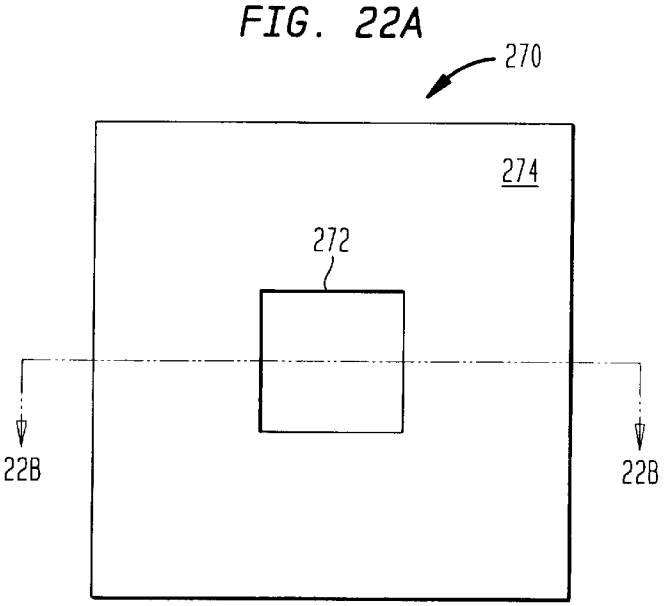
FIG. 22A shows an elevation view of a base for receiving a compartment blank in accordance with the present invention.
Figure 22B:
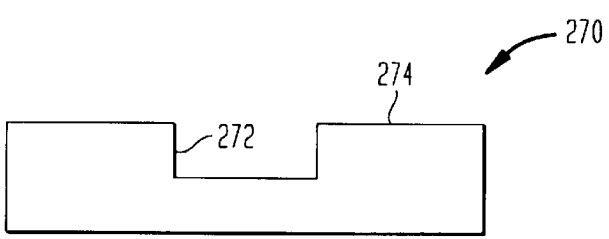
FIG. 22B shows a cross section of the base shown in FIG. 22A through the plane 22B—22B.

FIG. 22A shows an elevation view of a base 270 used for folding a blank into a compartment and for holding the folded compartment in position for loading and sealing. As described above, the turntable 252 shown in FIG. 21B includes four such bases 270 to allow the production process to be conducted in tandem. FIG. 22B shows a cross section of the base 270 shown in FIG. 22A through the plane 22B—22B. The base 270 is fabricated from metal or other suitable material and includes a cavity 272, the inner surface of which bears the shape of the blister-like compartment in the finished package. The base 270 further includes a flat upper surface 274 that, as described and illustrated below, is used for forming the adhesive flange of the blister-like compartment.

Figure 23A:
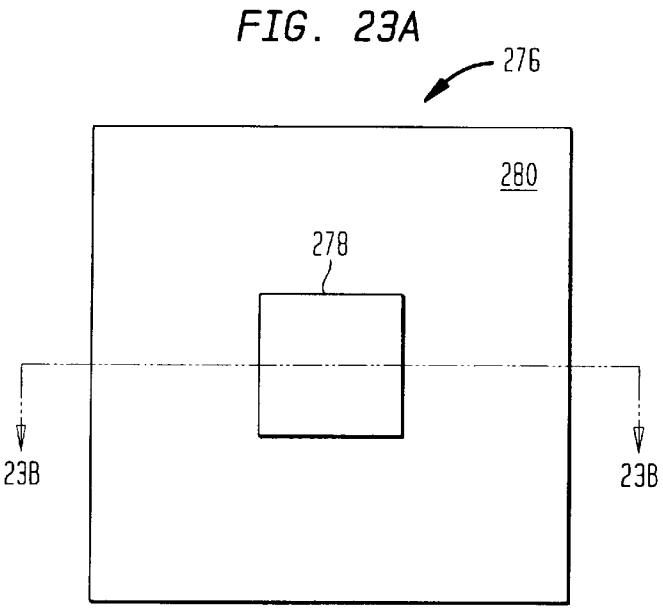
FIG. 23A shows an elevation view of a plug that mates with the base shown in FIGS. 22A and 22B to fold a blank into a blister-like compartment.
Figure 23B:
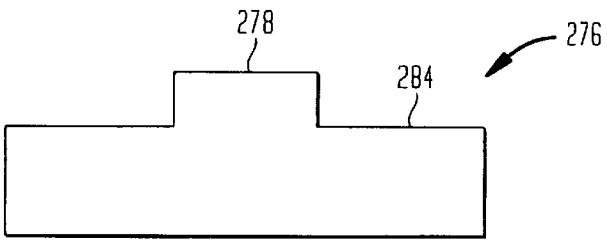
FIG. 23B shows a cross section of the plug shown in FIG. 6A through the plane 23B—23B.

FIG. 23A shows an elevation view of a plug 276, located at Station A, that is used in conjunction with the base 270 shown in FIGS. 22A and 22B to fold a blank into a blister-like compartment. FIG. 23B shows a cross section of the plug 276 shown in FIG. 23A through the plane 23B—23B. The plug 276 includes a protruding member 278 and flat surface 280 that are shaped to mate with the cavity 272 and flat surface 274 of the base 270 when the plug 276 has been inverted and properly positioned over the base 270. It will be appreciated that the base 270 and the plug 276 together function as a die for folding a blank into the shape of the blister-like compartment.

Figure 24A:
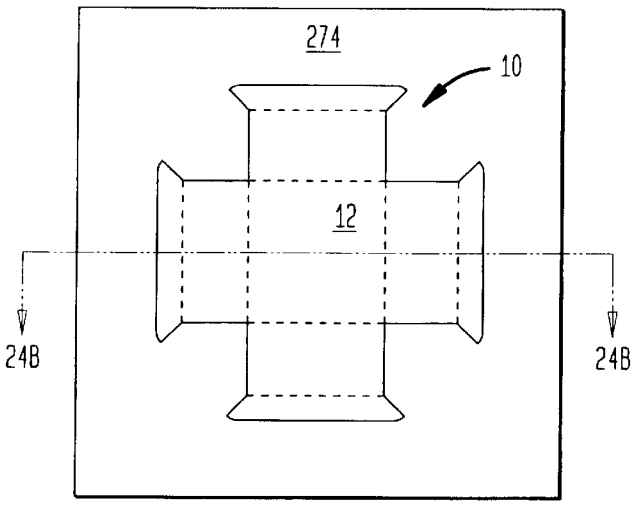
FIG. 24A shows an elevation view of the blank illustrated in FIG. 1 positioned on the base shown in FIGS. 22A and 22B.
Figure 24B:
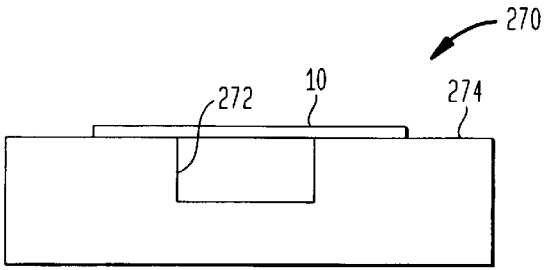
FIG. 24B shows a cross section of the blank and base shown in FIG. 24A through the plane 24B—24B.

FIG. 24A shows an elevation view of the blank 10 shown in FIG. 1 resting on the flat surface 274 of the base 270, with the front panel 12 of the blank 10 positioned over the cavity 272 in the base 270. FIG. 24B shows a cross section of the blank 10 and base 270 through the plane 24B—24B. In the present embodiment of the invention, the blank 10 is removed from the hopper 256 by a pivoting arm (not shown) having a suction head for gripping the blank. The arm pivots to precisely position the blank 10 on top of the base 270 before releasing the suction.

Figure 25A:
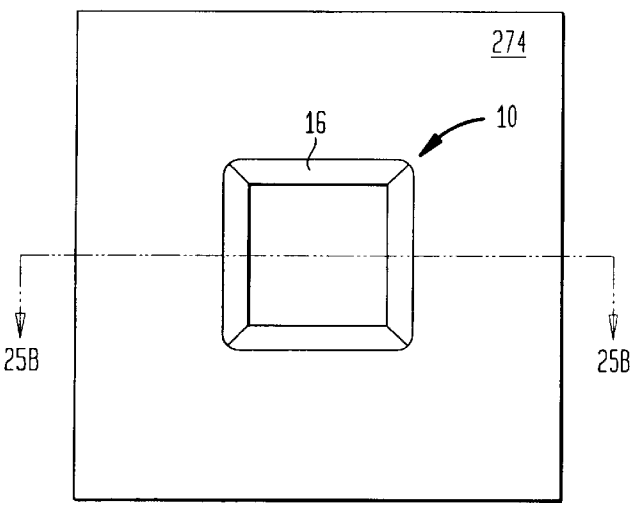
FIG. 25A shows an elevation view of the blank and base shown in FIGS. 24A and 24B with the blank pressed into the cavity in the base to form a blister-like compartment.
Figure 25B:
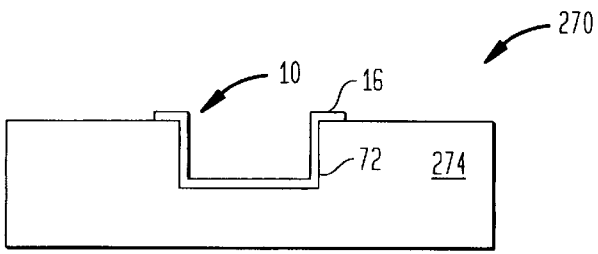
FIG. 25B shows a cross section of the blister-like compartment and base shown in FIG. 25A through the plane 25B—25B.

FIG. 25A shows an elevation view of the blank 10 that has been pressed into cavity 272 by the plug 276 illustrated in FIGS. 23A and 23B. FIG. 25B shows a cross section of the pressed blank 10 and base 270 through the plane 25B—25B. The scoring of the blank 10 allows the blank 10 to hold its folded configuration within the cavity 272. Also, as shown in FIG. 25A, after the pressing operation, the flange sections 16, which have been pressed between flat surfaces 274 and 280, now abut each other to form a substantially continuous flange.

After the operations illustrated in FIGS. 24A–B and 25A–B have been performed at Station A, the base 270 holding the folded blank 10 is then rotated by the turntable 252 to Station B for loading.

Figure 26A:
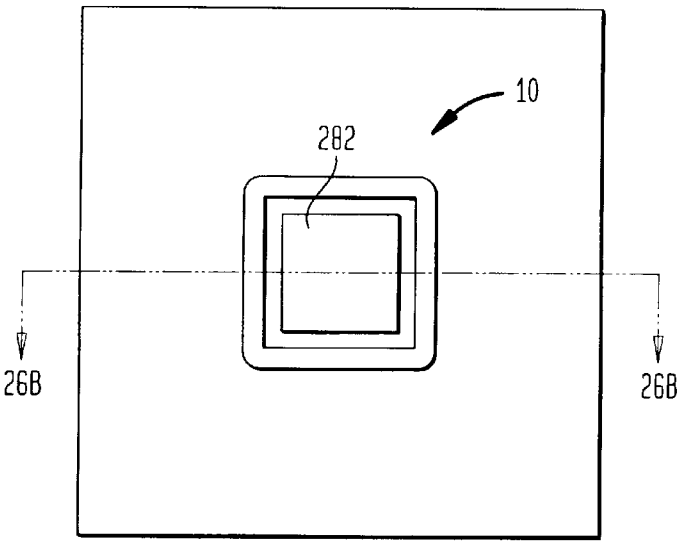
FIG. 26A shows an elevation view of the blister-like compartment and base shown in FIGS. 25A and 25B with an item to be packaged loaded into the blank.
Figure 26B:
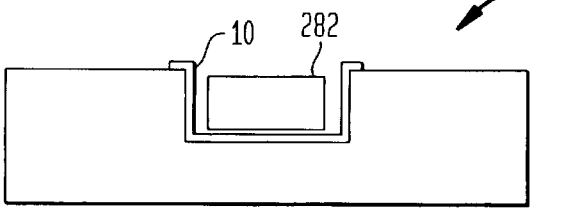
FIG. 26B shows a cross section of the blister-like compartment, base, and item shown in FIG. 26A through the plane 26B—26B.
Figure 29:
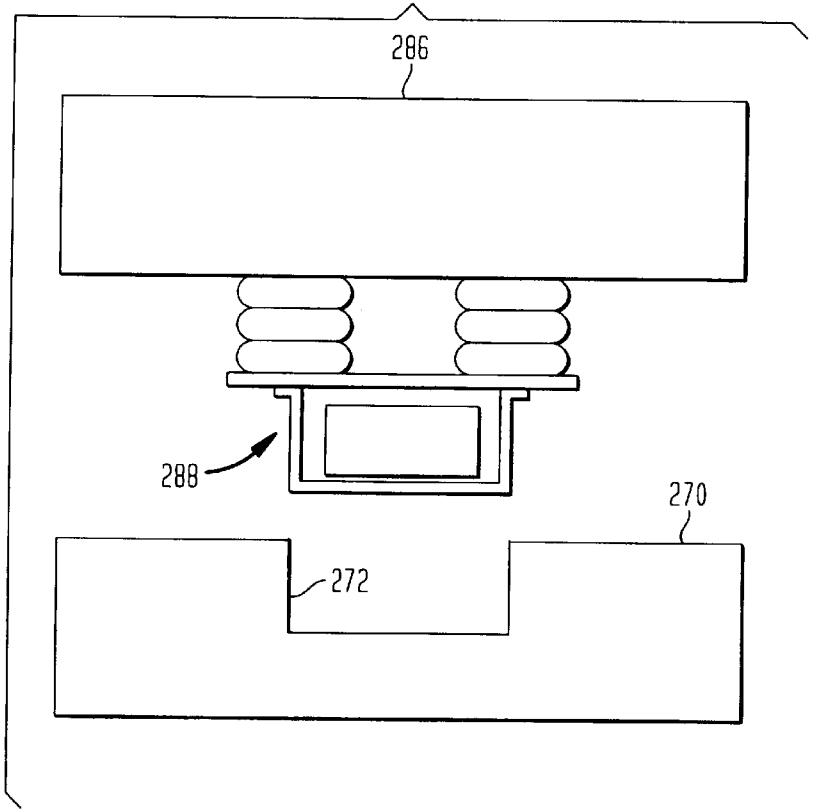
FIG. 29 shows a cross section of a suction head used to remove a finished package from the base.

FIG. 26A shows an elevation view of the folded blank 10 seated in cavity 272 that has been loaded with an item 282 to be packaged. FIG. 26B shows a cross section of the base 270, blank 10, and item 282 through the plane 26B—26B. As mentioned above, the loading of the folded blank 10 can be accomplished either by machine or by a worker. After the folded blank 10 has been loaded, the base 270 is rotated by the turntable 252 to Station C for placement of a card or other suitable backing.

Figure 27A:
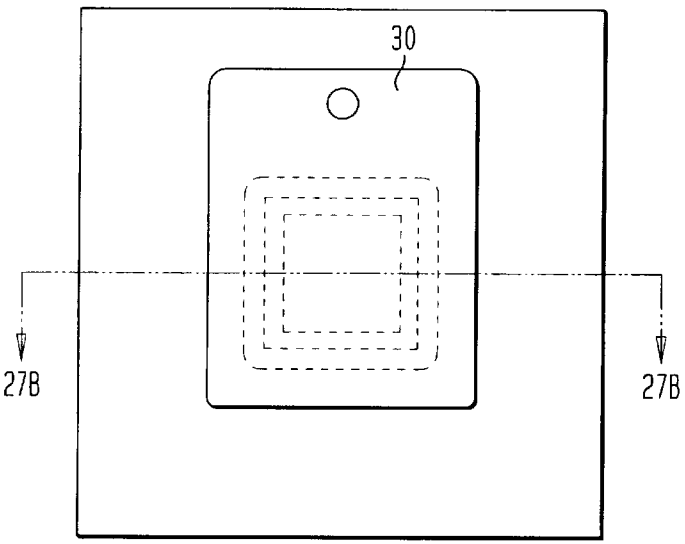
FIG. 27A shows an elevation view of the card shown in FIG. 2, positioned over the blister-like compartment, base, and item shown in FIGS. 26A and 26B.
Figure 27B:
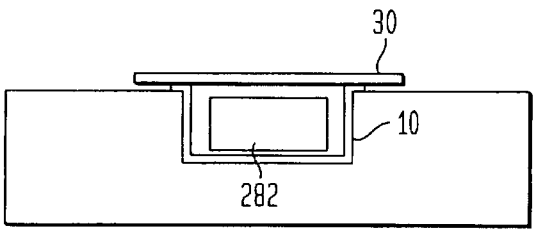
FIG. 27B shows a cross section of the blister-like compartment, base, item, and card shown in FIG. 27A through the plane 27B—27B.

FIG. 27A shows an elevation view of the card 230 shown in FIG. 2 that has been removed from the card hopper 260 and positioned on top of the folded blank 10. FIG. 27B shows a cross section of the base 270, blank 10, item 282, and card 30. In the present embodiment of the invention, the card 30 is positioned onto the folded blank 10 using an arm (not shown) similar to the arm used to position the blank 10 on the base 270 over the cavity 272. The turntable machine 250 may be adjusted to precisely place the card 30 in any number of desired positions. After the card 30 has been positioned, the base 270 is rotated by the turntable 252 to Station D for sealing.

Figure 28:
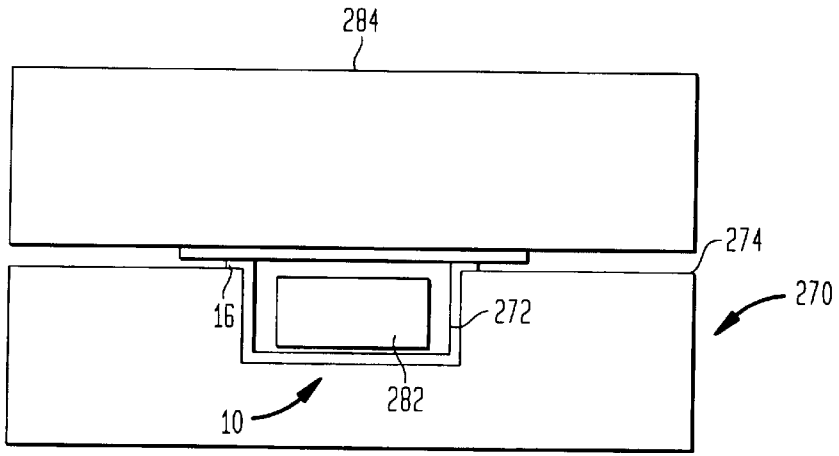
FIG. 28 shows a cross section of a press used to apply heat and pressure to the card and blister-like compartment shown in FIGS. 27A and 27B to cause the card to adhere to the blister-like compartment.

FIG. 28 shows a cross section of a press 284 that is used to apply heat and pressure to the card 30 such that it forms an adhesive bond with the flange 16 of the folded blank 10. As illustrated in FIG. 28, the flange 16 is pressed against the upper surface 274 of the base 270. After the sealing operation is completed, the base 270 is rotated by the turntable back to Station A. FIG. 12 shows a cross section of a vacuum gripping head 286 that is used to lift the finished package 288 out of the cavity 272 and to transport the finished package 288 to the holding bin 262. The cavity 272 is now free to receive a fresh blank to be made into another package.

It should be noted that it is possible to adapt the Koch turntable machine 250 to process multiple blanks at each base 270, instead of just one, by providing a plurality of suitably positioned cavities 272 at each base 270. Suitable modifications must be made to other components of the machine 250 to accommodate the plurality of cavities. In one embodiment of a multiple blank machine, the blank hopper 256 is configured to hold separate, side-by-side stacks of blanks 10. The top blank in each of the stacks is picked up simultaneously by a suction head having a suitable number of properly positioned suction elements. At Station A, the plug 276 includes a plurality of protruding elements 278 corresponding to the plurality of cavities 272 on the base 270, so that all of the blanks 10 on the base 270 may be folded simultaneously. Similar modifications are made to the other components of the turntable machine 250, as needed, to allow each of the plurality of blanks 10 on each base 270 to be processed simultaneously at each station.

Figure 30A:
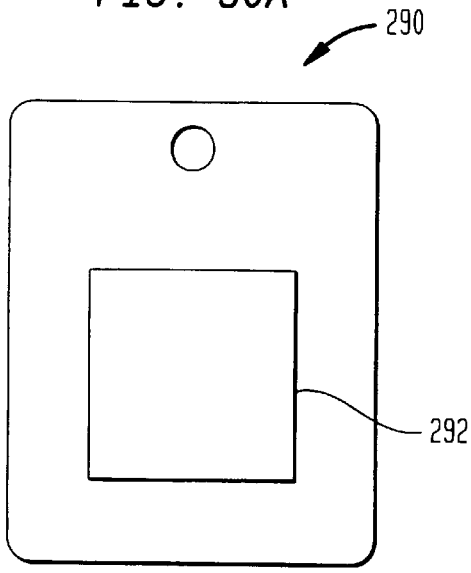
FIG. 30A shows an elevation view of a frame that can be used with the blank and card illustrated in FIGS. 1 and 2 to fabricate a framed package having a blister-like compartment.

The present invention may be used in package designs featuring alternative ways of affixing the blister-like compartment to a card. For example, one common type of blister package includes a frame that is fits closely around the base of the blister, with the flange of the blister being sandwiched between the frame and a card. Such a package design may be selected where, for example, it is desired to conceal the flange or where extra security is required. FIG. 30A is an elevation view of a frame 290 that can be used in conjunction with the blank 10 and card 30 illustrated in FIGS. 1 and 2, discussed above, to create a framed package.

As shown in FIG. 30A, the frame 290 has the same overall shape and size as the card 30, but further includes an square opening 292 that is shaped to receive the base of the blister-like compartment. Of course, the frame 290 does not have to have the same overall shape and size as the card 30. Also, the frame 290 and card 30 can be fabricated as a single piece that is folded around the blister-like compartment.

Figure 30B:
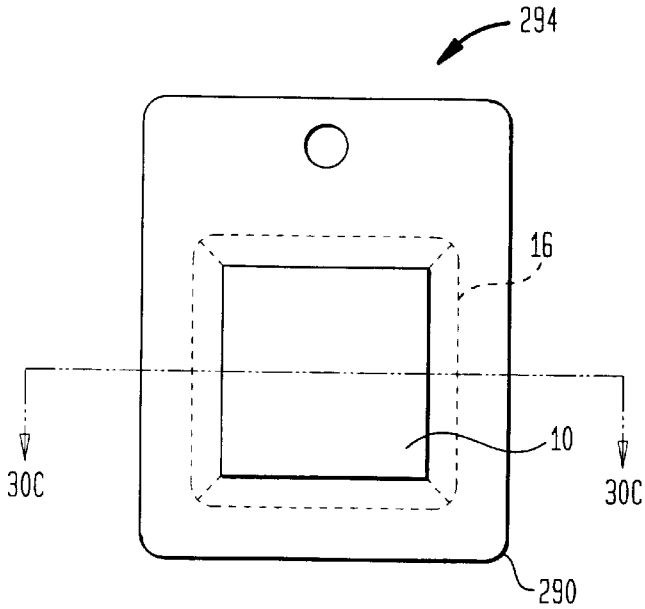
FIG. 30B shows an elevation view of a framed package fabricated from the frame shown in FIG. 30A.
Figure 30C:
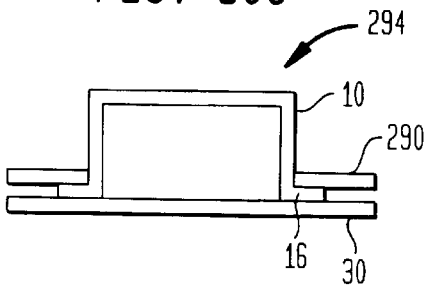
FIG. 30C shows a cross section of the framed package shown in FIG. 30B through the plane 30C—30C.

FIG. 30B shows a plan view of a framed package 294 fabricated from the frame 290 shown in FIG. 30A, the blank 10 shown in FIG. 1, and the card 30 shown in FIG. 2. FIG. 30C shows a cross section of the framed package 294 through the plane 30C—30C. As shown in FIGS. 30B and 30B, the frame 290 fits closely around the base of the blister-like compartment, with the flange 16 sandwiched between the frame 290 and the card 30. For purposes of illustration, in FIG. 30C, the frame 290 and the card 30 are illustrated with a small gap between them. However, because of the thinness of the material used to fabricate the blank 10, and the pliability of the material used to fabricate the frame 290 and the card 30, the frame 290 and the card 30 may be readily deformed towards each other to close the gap and to be adhered to each other. The adhesion may be accomplished by coating the card 30 and/or the frame 290 with a heat-sealing material.

The turntable process described above can be readily modified to manufacture a framed package. The frame is laid down first on the base 270 such that the opening of the frame is aligned over the cavity 272. The blank 10 is then laid down on top of the frame with its front panel 12 aligned over the cavity 272. Thus, when the plug 276 presses the blank 10, the central and side panels 12 and 14 of the blank 10 are urged through the opening 292 of the frame 290, while the flange sections 16 of the blank 10 remain on top of the frame 290. The remaining manufacturing steps are identical to those described above.

Figure 31:
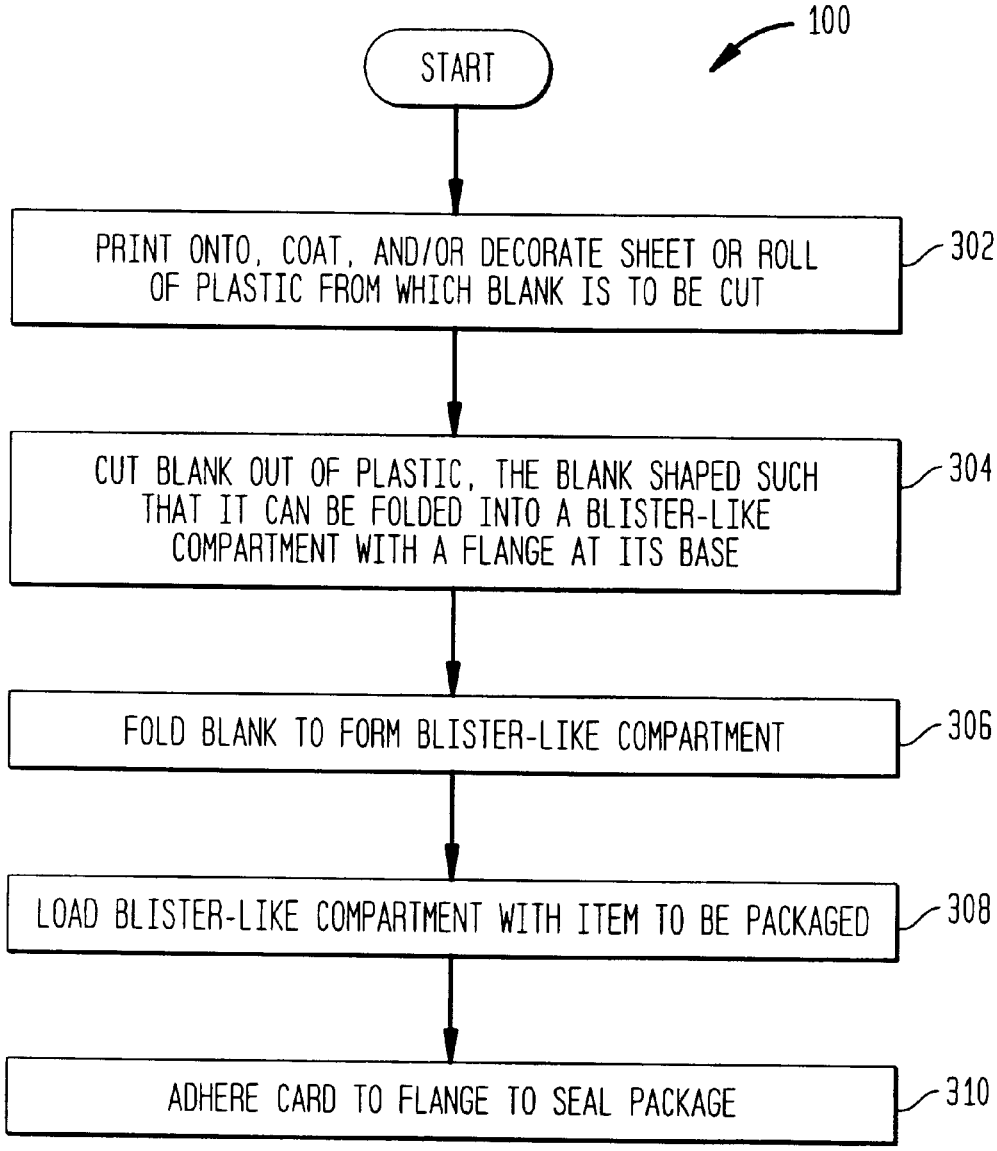
FIG. 31 shows a flowchart illustrating a method according to a further aspect of the invention for fabricating a package having a blister-like compartment for holding an item.

FIG. 31 shows a flowchart of a method 300 according to a further aspect of the invention for fabricating a package having a blister-like compartment for holding an item. The various steps of the method 300, and techniques for performing the steps of the method 300 have been described in detail above. In step 302, a sheet or roll of plastic material out of which the blister-like compartment is to be fabricated is printed on, coated, and/or decorated. As described above, any techniques used to print on, coat, and/or decorate a sheet or roll of plastic material may be used, as desired. In step 304, a blank is cut out of the plastic material. The blank is shaped such that it can be folded into a blister-like compartment with a flange at its base. As described above, if the blister-like compartment is to have cutout sections or perforations, these cutout sections or perforations may be made using a die cutting technique during the process of cutting the blank out of the plastic material. Also, as described above, score lines may be created at this time as well, using a microperforation technique, soft creasing, or other suitable scoring technique. In step 306, the blank is folded into a blister-like compartment. This may be accomplished by pressing the blank into a suitably shaped cavity, as described above. As further described above, where a framed package is being fabricated, the blank is pressed through the frame into the cavity with the flange remaining on the other side of the frame. In step 308, the folded blank is loaded with the item to be packaged. As described above, this may be performed either automatically or by a worker. In step 310, the package is sealed by adhering a card to the flange. This can be accomplished by creating an adhesive bond between the front surface of the card and the flange or, in the case of a framed package, can be accomplished by adhering the flange between the front surface of the card and the rear surface of the frame.

One benefit of the present invention is that it allows matter that is normally printed onto the card 30 to be printed instead onto the blank 10. This could include, for example, a company's logo, the name of the product, as well as the contents of the package, instructions, warnings, bar codes, etc. This in turn would allow a manufacturer to decrease the size of the card 30, resulting in a savings in material costs, as well as the amount of space required to store and display the packaged item.

It will be appreciated that the present invention has many applications, some of which have been alluded to above. First, the invention can be used to decorate the blister-like compartment itself, thereby eliminating the need for labels or inserts and their associate inventory and application costs. Second, because the blister-like compartment readily lends itself to die cutting of any of its panels and flange sections, a blister-like compartment can be designed having a portion of the packaged product, such as a brush handle, extend out of the package, allowing the customer to handle part of the product. This type of packaging could be used, for example, to house portions of a product that are either subject to damage, such as bristles on a paintbrush, or that are potentially injurious, such as a razor blade. Such a package could be designed to be significantly smaller than traditional packages, resulting in a cost savings through the use of less packaging material.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. A package, comprising:

a backing; and a blister-like compartment including a plurality of panels defining an enclosure with a mouth at its base, the panels having lateral edges that are shaped to abut each other, the panels including lateral flaps at the lateral edges, the lateral flaps being foldable along the lateral edges to abut inner surfaces of the panels such that any openings between adjacent panels are concealed, thereby creating a visual impression that there is no break between adjacent panels;

the blister-like compartment further including at its base at the mouth's perimeter a plurality of flange sections that are affixed to the backing to enclose an item into the blister-like compartment, the flange sections having lateral edges that are shaped to abut each other, such that in the blister-like compartment the flange sections together form a substantially continuous flange around the mouth of the blister-like compartment, the panels, flange sections, and backing forming a tamper-evident enclosure, the blister-like compartment being formed, without thermoforming, from a blank that has been cut from a sheet of see-through plastic material.

2. The package of claim 1, wherein the blank from which the blister-like compartment is formed has been printed upon such that printing appears on one or more panels of the blister-like compartment.

3. The package of claim 2, wherein the printing includes a design.

4. The package of claim 2, wherein the printing includes text.

5. The package of claim 2, wherein a portion of the panels of the blister-like compartment does not have printing thereon.

6. The package of claim 1, wherein the backing is a card.

7. The package of claim 6, wherein the card is coated with a heat-sealing material that is used to affix the flange to the card.

8. The package of claim 6, wherein the flange is coated with a heat-sealing material that is used to affix the flange to the card.

9. The package of claim 6, wherein the card and the flange are coated with a heat-sealing material that is used to affix the flange to the card.

10. The package of claim 1, wherein the blister-like compartment comprises a front panel having defined edges and a plurality of secondary panels, each secondary panel, in the blank from which the blister-like compartment is formed, extending in an outward direction from a respective edge of the front panel and including an outer edge, the outer edges of the secondary panels defining the mouth of the blister-like compartment.

11. The package of claim 10, wherein the front panel edges are straight.

12. The package of claim 10, wherein at least one of the front panel edges is curved.

13. The package of claim 10, wherein the flange comprises a plurality of flange sections, each flange section, in the blank from which the blister-like compartment is formed, extending in an outward direction from the outer edges of the secondary panels.

14. The package of claim 10, wherein each secondary panel includes a pair of lateral edges, each lateral edge abutting a lateral edge of an adjacent secondary panel in the blister-like compartment.

15. The package of claim 14, wherein the blank includes a plurality of flaps each extending from a secondary panel, each flap being positioned such that when the blank is formed into a blister-like compartment, the flap is folded such that it abuts a secondary panel adjacent to the secondary panel from which the flap extends, thereby covering any opening between the lateral edges of the two secondary panels.

16. The package of claim 15, wherein each flap is folded such that it abuts an inner surface of the adjacent secondary panel.

17. The package of claim 16, wherein each flap is sealed to the inner surface of the adjacent secondary panel.

18. The package of claim 1, wherein the lateral edges of the flange sections are beveled at an angle such that the lateral edges of adjacent flange sections abut each other.

19. The package of claim 1, wherein the lateral flaps are sealed to the inner panel surfaces.

20. The package of claim 1, wherein the lateral flaps are unsealed.

* * * * *